United States Patent [19]

Brown

[11] Patent Number: 4,789,153

[45] Date of Patent: Dec. 6, 1988

[54] EXERCISE SYSTEM

[76] Inventor: Lawrence G. Brown, 4312 Bellaire Dr. South, Apt. 104 East, Fort Worth, Tex. 76109

[21] Appl. No.: 782,354

[22] Filed: Oct. 1, 1985

Related U.S. Application Data

[63] Continuation-in-part of Ser. No. 17,599, Mar. 5, 1979, which is a continuation of Ser. No. 933,470, Aug. 14, 1978, Pat. No. 4,441,705.

[51] Int. Cl.[4] ..... A63B 21/00; A63B 69/06

[52] U.S. Cl. ..... 272/73; 272/72

[58] Field of Search ..... 272/69, 72, 128, 73, 272/71, 93; 73/379

[56] References Cited

U.S. PATENT DOCUMENTS

| | | | |
|---|---|---|---|
| 642,919 | 2/1900 | Nott | 272/73 |
| 3,283,997 | 11/1966 | Bambenek et al. | 272/73 |
| 3,767,195 | 10/1973 | Dimick | 272/73 |
| 4,396,188 | 8/1983 | Dreissigacker et al. | 272/72 |
| 4,441,705 | 4/1984 | Brown | 272/73 |
| 4,537,396 | 8/1985 | Hooper | 272/73 |
| 4,589,656 | 5/1986 | Baldwin | 272/73 |

OTHER PUBLICATIONS

"Second Wind", Bicycling Magazine, Dec. 1985, pp. 86, 88, 90, 91, 93–97.

*Primary Examiner*—Ronald L. Frinks
*Assistant Examiner*—S. R. Crow
*Attorney, Agent, or Firm*—Klaas & Law

[57] ABSTRACT

Exercising apparatus comprising a flywheel-type energy storage and fan-type resistance load applying system which is connectible to a variety of human force input systems such as a leg-operated bicycle-type system, a hand operated rowing-type system, etc. through a chain-type drive system which may include multiple speed and force multiplying and force controlling devices.

40 Claims, 12 Drawing Sheets

Fig-9
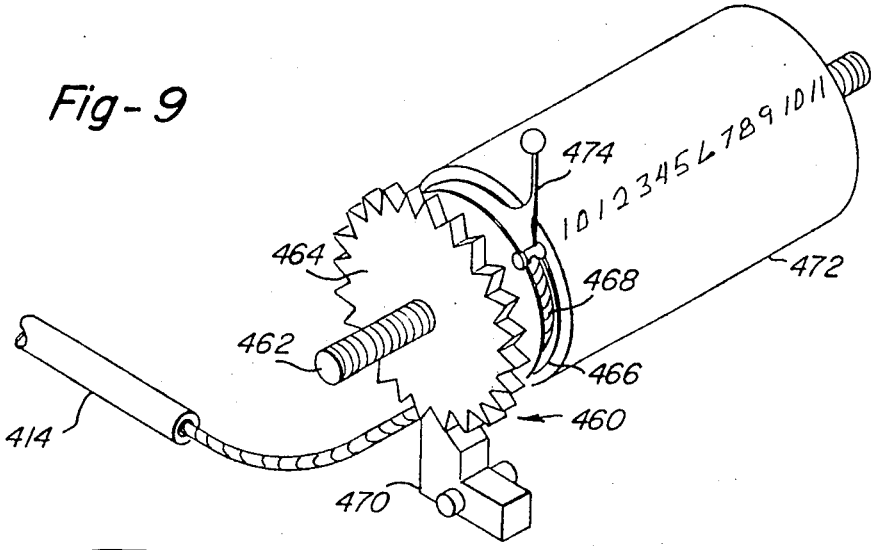
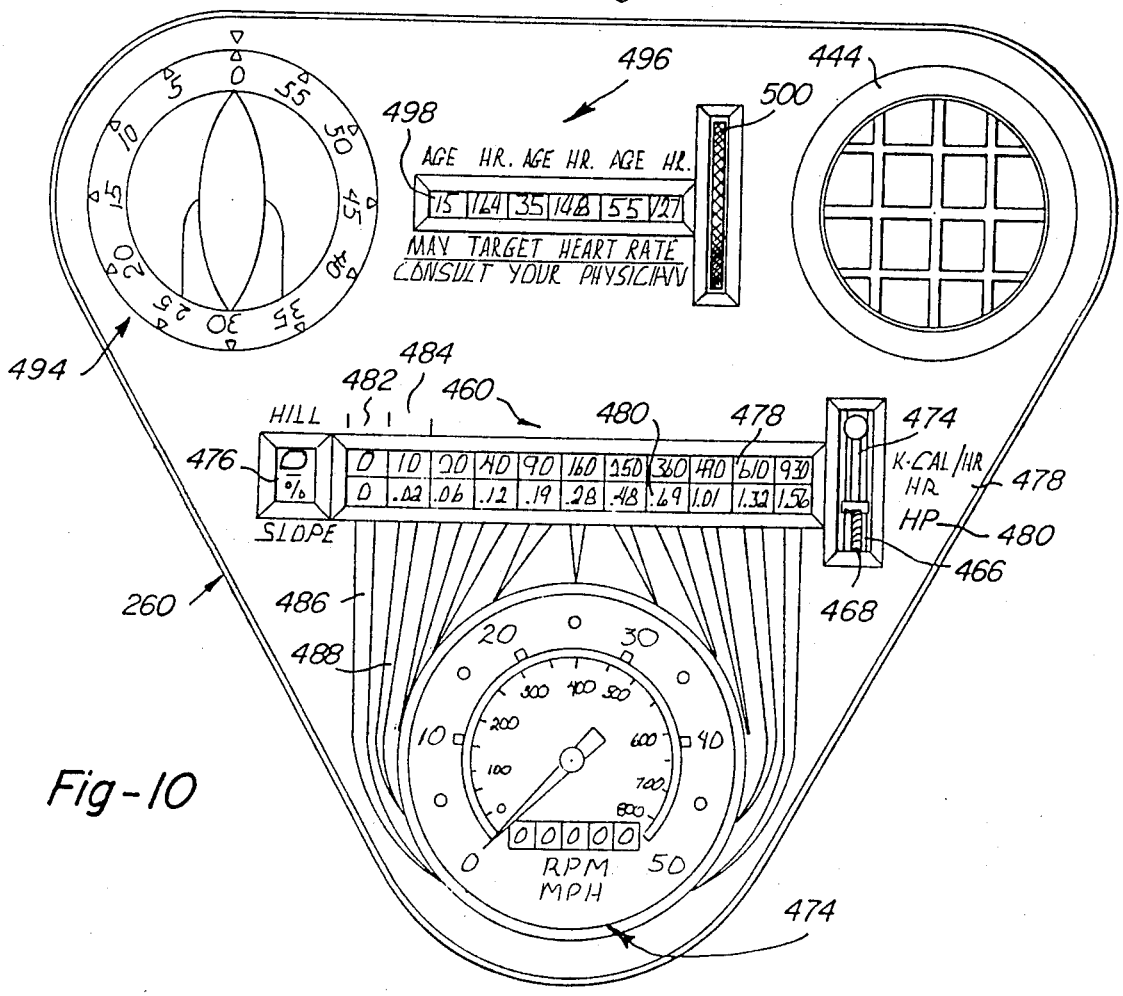
Fig-10

EXERCISE SYSTEM

This application is a continuation-in-part of my prior copending U.S. patent application, Ser. No. 17,599 filed Mar. 5, 1979, which was a continuation of Ser. No. 933,470 filed Aug. 14, 1978, now U.S. Pat. No. 4,441,705, the benefit of the filing dates of which are claimed herein.

BACKGROUND AND SUMMARY OF INVENTION

This invention relates generally to stationary type exercise apparatus which may be used to provide a variety of exercise systems having a manually operable drive system subject to a variable load and being operable within predetermined conditions and parameters.

It has long been known that the number of hours and severity of training are not necessarily equateable to the attained level of physical fitness. Tests of cross country skiers, cyclists, and some long distance runners have consistently shown markedly superior cardio-aerobic development as well as substantial differences in muscular stamina between athletes. Since such differences, particularly in cardio-aerobic development, persist for groups of athletes, rather than individuals, I have concluded that it is the type of activities and training environment, rather than individual differences, that produced their superiority. I have used studies of the training and competitive environments of groups of athletes having very high cardioaerobic and stamina levels to define an ENVELOPE OF CONDITIONS which is substantially more productive than prior art systems and I have designed exercise equipment operable within such envelope to achieve better results than prior art exercise systems.

During exercise, the human brain senses the status quo, then commands the muscles, causing the lungs and heart to supply the oxygen carrying blood to the points of use. The difference between benefits from exercise stems directly from the differences in the status quo presented to the brain: two people using two differently designed exercycles (for example) will benefit differently from the same time and effort on the equipment... The conditions I have found to be essential to proper "status quo", from which the best brain-muscle-heart-lung interaction results, involve an interrelationship between the following parameters:

(a) TOTAL ENERGY LEVEL stored in the exercise equipment at any point in time (lb-ft, or kg-m etc)

(b) POWER (RATE of work input) NEEDED TO OVERCOME ENERGY DISSIPATION, AND MAINTAIN THAT LEVEL OF ENERGY (lb-ft/sec, or HP, watts etc)

(c) POWER (RATE of work input) NEEDED TO REACH THE NEXT ENERGY LEVEL designated. }NOTE: this condition can be equally clearly defined alternately as: TIME INTERVAL IN WHICH THE NEXT DESIGNATED ENERGY LEVEL MUST BE REACHED.]

While the parameters a, b and c above may be used to define an ENERGY STORAGE & DISSIPATION SYSTEM essential for best yields from exercise or rehabilitation efforts, an additional condition is required for maximization of such yields which is dependent on the type of exercise equipment to be used. This additional condition is that:

(d) THE MECHANICAL RATIO (advantage or disadvantage, often referred to as "gear step-up" or "step-down") must be properly matched between the type of ENERGY STORAGE & DISSIPATION system and the type of exercise equipment (for example exercycle, rower, leg machine etc..) being utilized with it.

One of the objects of the present invention is to provide new and improved exercise apparatus and systems which provide a maximum level of physical conditioning by cardio-aerobic type exercise simulating the characteristics of exercise during certain competitive activities such as the actual riding of a bicycle. The characteristics of exercise during actual riding of a bicycle, include, among other things, variations in wind resistance dependent upon the speed of the bicycle and riding conditions; variations in level of momentum dependent upon the speed of the bicycle and the weight of the rider and variations in load dependent upon topography, i.e. uphill, downhill and level riding conditions. At the present time cycling has become a very popular sport for both recreational riders and for large numbers of racing and cross-country bicycling enthusiasts. Indeed, the health benefits of both actual bicycle riding and the use of prior art stationary bicycle-type exercise apparatus have been long recognized by health authorities and the general public.

Some of the drawbacks of prior stationary bicycle-type exercise apparatus have included lack of similarity to actual bicycle riding conditions as well as relatively high cost of manufacture and bulkiness of the apparatus.

The apparatus of the present invention enables substantial duplication of actual bicycle riding conditions whereby the same coordination of brain, heart, lung and body muscles are used in substantially the same way as doing actual bicycle riding. The duplication of actual bicycle riding conditions is of substantial benefit to all bicycle riders and for other types of exercise. In addition, an important use of the present invention is as a rehabilitation exerciser device for physically handicapped persons and/or persons desiring higher levels of cardio-aerobic fitness. In this connection, the present invention enables smooth continuous uniform application of input force and loading of the system without the usual loss of momentum and velocity encountered in conventional type exercising apparatus.

The present invention enables the use of both (1) a self-contained type exercise apparatus including permanently mounted parts; and (2) an attachment-type exercise apparatus which may be adapted to employ portions of existing apparatus such as an actual bicycle thereby reducing cost and enabling use of exercise apparatus such as bicycles already owned and actually used by the exerciser for bicycle riding or exercise apparatus of special design. In one form of the invention, the construction and arrangement of the exercise apparatus is such as to enable mounting of a conventional bicycle on the exercise apparatus by the simple expedient of removing one of the wheels of the bicycle.

Both types of exercise apparatus are particularly adapted for use with variably selectable multiple-speed bicycle-type drive systems, such as presently commercially available three-speed, five-speed or ten-speed drive systems or, more preferably, a cam-type drive system of the type disclosed in my U.S. Pat. Nos., 4,133,550, 4,206,660, 4,281,845, 4,309,043 and 4,461,375, the disclosures of which are incorporated herein by reference. Each type of exercise apparatus comprises a -relatively small size and weight fly-wheel means driven at relatively high velocities by the drive system for energy storage in accordance with pre-selected parameters, e.g. to simulate inertial and momentum forces during actual riding of a bicycle; and an automatically variable resistance load applying means driven by the drive system for automatically applying continuously variable resistance loads proportional to drive system velocity in accordance with preselected parameters, e.g. to simulate variations in resistance loads encountered during actual riding of a bicycle at varying velocities. Selectively changeable fixed resistance load applying means may be employed for selectively applying variable fixed resistance loads to the drive system to simulate fixed resistance loads variously encountered under actual bicycle riding conditions. Each type of exercise apparatus may further comprises controls and instrumentation for selective simulation of particular actual bicycle riding conditions and/or display for the exerciser of various exercise conditions, including accurate energy dissipation, both instantaneous and cummulative.

Another object of the present invention is to provide exercise apparatus which is readily adaptable for use in various kinds of exercise systems to perform various kinds and levels of exercises. For example, the present invention may be employed for leg-operated exercises of the type involving rotation of a pedal-operated rotatable drive crank or arm-operated exercises through a hand-held device or any other kind of exercise.

In general, the invention involves the use of energy storage means such as, preferably, a rotatable flywheel or other suitable devices such as compressible fluid apparatus, etc. for storage of energy and automatic variable load-applying means for dissipation of energy such as friction devices, fluid driven pumps or preferably a rotatable air brake device providing variable resistance by passage of air therethrough variably proportional to speed of rotation. In the presently preferred embodiment of the invention, a single rotatable device provides both the energy storage function and the variable load-applying function. In addition, a positive non-slip drive means, such as a toothed timing belt and toothed gear means, is employed to transmit force to the energy storage and variable load-applying means. The foregoing components of the exercise system may be constructed and arranged as a single small-size relatively low-weight, self-contained unit adapted to be operably associated with a variety of different kinds of exercise devices and/or systems. The unit comprises only a simple, low-cost one-piece support frame means, a first input shaft means for supporting a gear means, a second output shaft means for supporting the energy storage and variable resistance applying means, and a force transmission means which may include only a first gear means associated with said first input shaft means, a second gear means associated with said second output shaft means, and a continuous loop toothed belt means. Input force is transmitted to the first input shaft means through a one-way clutch-type sprocket wheel means mounted on one end of said first input shaft means. The sprocket wheel means is driven by a chain device connected to a chain-type drive system which is manually operated by a person performing a particular exercise. A variable fixed load-applying device may be associated with the apparatus to provide additional load. Suitable instrumentation and display means may be provided to accurately display various exercise conditions.

Other objects and advantages of the present invention are shown and described hereinafter.

BRIEF DESCRIPTION OF DRAWING

FIG. 9 is a perspective view of another portion of the apparatus of FIG. 7;

FIG. 10 is an enlarged plan view of an instrumentation housing and display apparatus shown schematically in FIG. 7;

DETAILED DESCRIPTION

Figure 1:
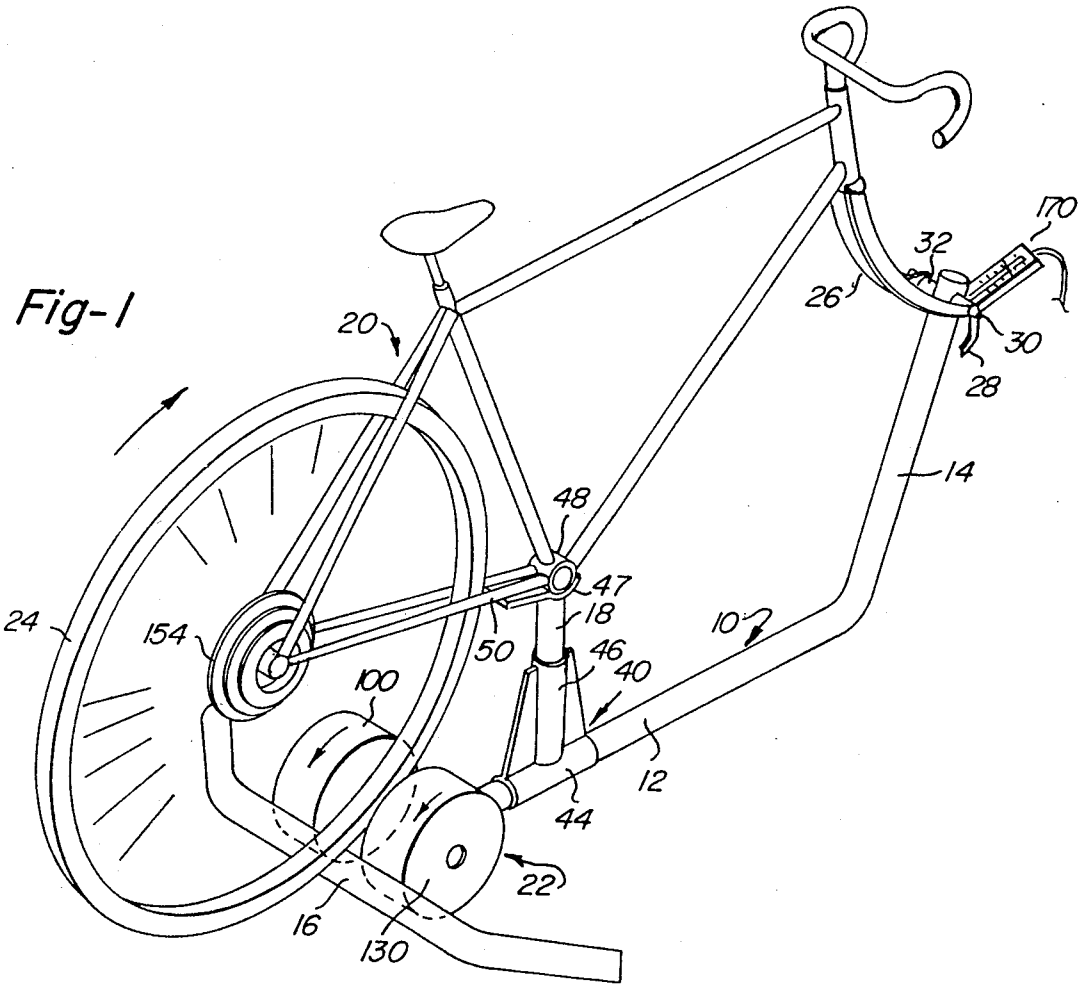
FIG. 1 is a schematic perspective view showing an actual bicycle, with front wheel parts removed, mounted on a separate exercise apparatus.

In general, the exercise apparatus of FIG. 1 comprises a stationary support frame means 10 having a main elongated horizontally extending bottom support member 12 with a upwardly extending front end support portion 14; a rear laterally extending stabilizer member 16; and a central upwardly extending support member 18 for supporting a bicycle 20, with the front wheel removed, in a vertical upright attitude. A variable load-applying means 22 is mounted on the support member 12 of the support frame means 10 for drivable engagement with the rear wheel 24 of the bicycle 20.

The frame means 10 is preferably made of tubular metallic material such as steel or aluminum. The support member 12 and the stabilizer member 16 may be permanently fastened together as by welding or may be made as separable sections connected by threaded fasteners or the like to facilitate shipping and storage. The front end support portion 14 may be integral with the bottom member 12 as illustrated or may be a separate member suitably attached thereto by threaded fasteners or the like (not shown) for ease of shipping and storage. The size and shape of the front end support portion 14 is such as to receive and rigidly support the lower end of the fork 26 of a bicycle with the front wheel removed. A conventional quick release front wheel axle coupling 28 may be employed with a conventional front wheel axle member 30 or the like mounted in a support hub 32 and extending through aligned openings in the upper end of support portion 14. The central support member 18 is adjustably slidably mounted on the bottom member 12 by a bracket device 40 made of two half pieces secured by suitable threaded fastener devices 42 to provide a horizontal tubular portion 44 to receive bottom member 12 and a vertically extending tubular portion 46 to receive tubular member 18. A cradle member 47 is mounted on the top of the member 18 for engaging and supporting a conventional bicycle crank arm and shaft hub 48 with suitable bracket and threaded fastening devices 49 securely mounting the hub 48 on the cradle member 46 in association with the lower rearwardly extending bicycle frame members 50.

The variable load-applying means 22 is slidably adjustably mounted on the bottom member 12 by suitable bracket members 60, 62 and threaded fastener devices 64, 66. The variable load-applying means 22 comprises a main shaft member 68 rotatably supported by conventional bearing means 70, 72 mounted in hub portions 73, 74 in upwardly extending flange portions 75, 76 of the bracket member 60. A driven load applying wheel member 77, preferably having a high friction peripheral surface 78 of suitable material such as aluminum or rubber-like material, is fastened to shaft member 68 and is frictionally driveably engageable with the rear wheel tire 79 of the bicycle. A pair of axially spaced guide flange members 80, 82 are mounted at the sides of the wheel member 77 to confine the rear bicycle wheel therebetween. Spacer sleeve members 84, 86 are mounted between the flange members 80, 82 and the bearing means 70, 72.

A flywheel means 100 is fixedly mounted on one end of shaft member 68 for simulating the momentum forces encountered during actual bicycle riding. The flywheel means 100 of the preferred embodiment comprises a cylindrical member 102 of steel or the like having a suitable size and weight to effect the desired results. If desired, weight changing means (not shown) may be provided by suitable attachment devices on the cylindrical member 102 or the cylindrical member may be replaced by other cylindrical members of different sizes and weights.

Figure 3:
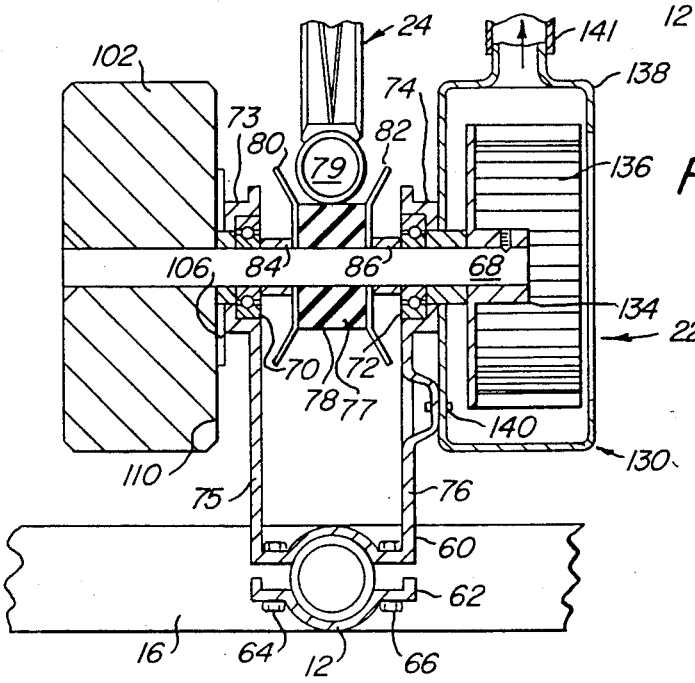
FIG. 3 is a cross-sectional view of a portion of the exercise apparatus of FIG. 1 taken along the line 3—3 in FIG. 2.
Figure 4:
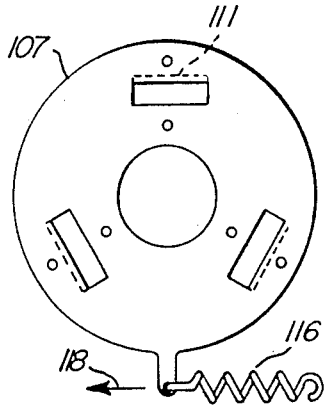
FIGS. 4 and 4*a* are a side elevational view and an enlarged cross-sectional view of a variable fixed load-applying device utilized with the exercise apparatus of FIGS. 1–3.
Figure 5:
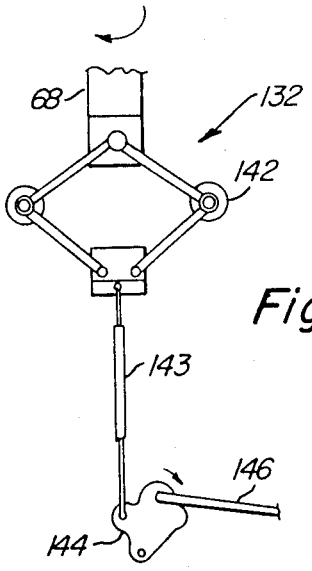
FIG. 5 is a side elevational view of a variable speed control device utilizable as an alternative embodiment with the apparatus of FIG. 4.
Figure 4A:
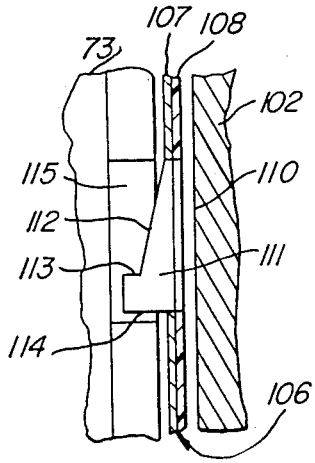

A first adjustable motion retarding fixed load-applying means 106, FIGS. 3 & 4, may be associated with the flywheel member or another portion of variable load-applying means 22 or the bicycle wheel to enable adjustment of motion retarding force applied to the rear wheel of the bicycle. Means 106 comprises a disc-like frictional braking device 107, FIGS. 4 & 4*a*, mounted circumjacent shaft member 68 for limited axial and rotative displacement relative to the hub portion 73 to cause engagement of friction means 108, in the form of a lining or pads (not shown) with side surface 110 of member 102. Three laterally extending cam tab means 111, having inclined cam surfaces 112 and stop surfaces 113, 114, are located in corresponding notches 115 in hub portion 73 for variable adjustable loading against the bias of a return spring 116 by an adjustment device such as a cable 118 or the like.

The variable load-applying means 22 further comprises speed-responsive load control means 130, FIGS. 1–3, or 132, FIG. 5, for automatically increasing and decreasing the load applied to the driven wheel means in accordance with the rotational speed of the rear wheel.

Figure 2:
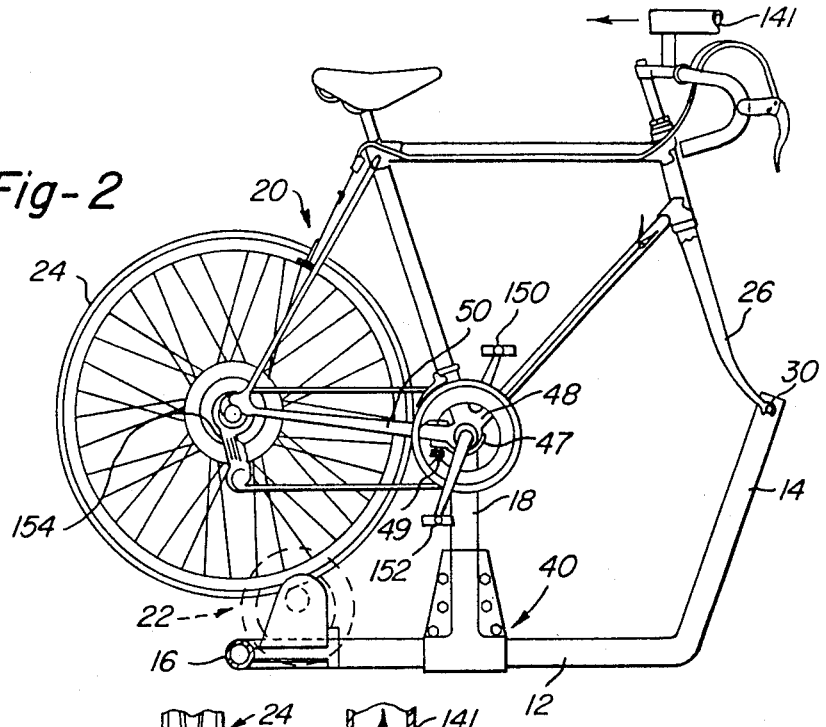
FIG. 2 is a side elevational view of the exercise apparatus of FIG. 1 with a multiple-speed bicycle mounted thereon in operative position.

In the embodiment of FIGS. 1–3, the load control means 130 comprises a conventional cage-type rotary air blower member 134 fixedly mounted on the other end of shaft 168 opposite the flywheel means 100 with fan blade members 136 peripherally enclosed by a cylindrical housing member 13 fixedly mounted on flange portion 76 of bracket member 60 by suitable fastening means 140. The construction and arrangement is such as to provide restricted air flow through the blade members 136 so that the air resistance to rotation of the blower member 134 is proportional to the rotational speed thereof to simulate air resistance when actually riding a bicycle. In addition, if desired, a length of flexible tubing 141 may be connected to the air chamber in housing member 138 to provide a flow of air in front of the rider simulating the air flow during actual bicycle riding. The alternative speed-responsive load control means 132 of FIG. 5 comprises a conventional centrifugal control device 142 rotatable by shaft 68 to cause variable linear displacement of a control member 143 proportional to rotational speed. Control member 143 may be suitably operatively connected to braking device 107 through a pivotal connecting member 144 and a cable member 146.

In operation, a conventional bicycle may be mounted on the exercise apparatus by the simple expedient of removing the front wheel of the bicycle and mounting the bicycle in the manner previously described with such adjustments in the adjustable mounting devices as may be necessary to accommodate different makes and sizes of bicycles. When the bicycle is properly mounted, the rear tire 79 of the bicycle frictionally driveably engages the outer periphery 78 of the driven wheel member 77. When the bicycle is ridden, i.e., the foot pedals and crank arms 150, 152 are rotated, any conventional multiple-speed bicycle drive system 154 is operated to cause rotation of the rear bicycle wheel of the bicycle and rotation of the driven wheel member 77. The frictional retarding force applied by the driven wheel member to the rear bicycle wheel is proportional to the effect of the various load variation devices associated with the main shaft member 68. The flywheel means 100 simulates momentum forces. The use of a suitable variable motion retarding fixed force applying means 106 enables simulation of uphill, downhill or flat riding conditions as well as any other load conditions desired by the rider. The air resistance loading means 130 provides a resistance force which is directly proportional to bicycle speed to simulate air resistance during actual bicycle riding. In addition, if the centrifugal control device 142 is utilized in connection with the brake means 107, the retarding force is automatically controlled in direct relationship to speed of rotation of the rear wheel.

Figure 6:
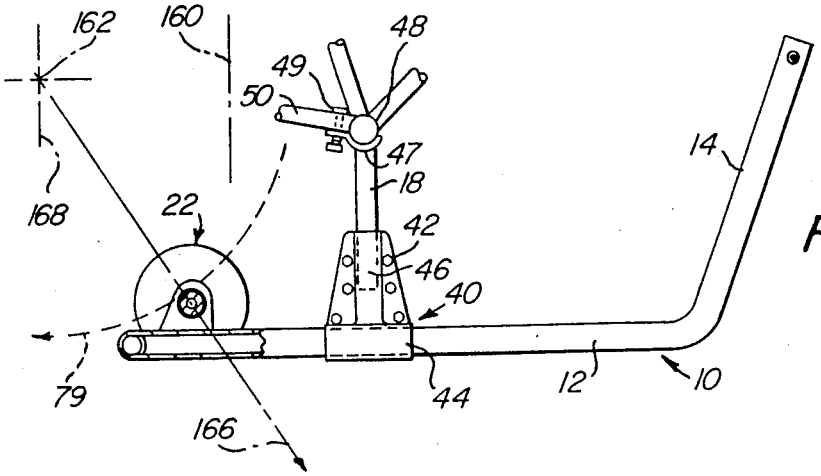
FIG. 6 is a partial side elevational view of the exercise apparatus of FIGS. 1–4 showing a portion of the bicycle apparatus mounted thereon.

As illustrated in FIGS. 1 & 6, the construction and arrangement is such as to require minimum space with maximum stability in use. The variable load-applying means 22 is located between the rear wheel 24 and the hub 47 so that none of the exercise apparatus is located rearwardly of the rear wheel axis of the bicycle. In addition, the forwardmost portion of the exercise apparatus terminates at the front wheel axle mounting position. Not only is the length of the exercise apparatus less than the length of the bicycle, the height of the exercise apparatus is minimized with only slightly more clearance than that required for rotation of the rear wheel and pedal and crank arms being provided. In the preferred embodiment, as illustrated in FIG. 6, the lowermost portion of the rear wheel 79 of the bicycle is located in a plane substantially coplanar with the uppermost surface of the lower support member 12 which may be made of 2 inch diameter tubing material. Thus, the bicycle is mounted within approximately 2 inches or less of the normal ground engaging position during actual bicycle riding.

Maximum stability with minimum size and weight has been achieved by locating the variable load-applying means 22 in relatively close proximity to a vertical plane 160 extending below the bicycle seat so that the center of gravity of the bicycle and the rider are in relatively close proximity to the variable load-applying means. Thus, the stabilizer member 16 may be of relatively short length and located forwardly of the axis of rotation 162 of the rear wheel in relatively close proximity to the plane 160 of the bicycle seat between the rear wheel axis and the crank hub 48. The shape of the stabilizer member 16 may be varied as necessary or desirable and may include forwardly extending end portions, illustrated in FIG. 1, located in relatively close proximity to a vertical plane including the center of gravity adjacent the bicycle seat. The location of the variable load-applying means 22 is such that the weight thereof, approximately 25 pounds, in the present preferred embodiment, is effective to provide maximum stabilization and the weight of the frame means 10 may be as low as approximately 10 pounds with use of aluminum tubular material as is presently preferred. Also, the location of the flywheel means 100 and the speed responsive resistance means 130 on opposite ends of shaft 68 provides good balance and weight distribution.

Furthermore, the location of the load-applying means 22 in front of the rear wheel of the bicycle most nearly simulates actual riding conditions and assures positive driving contact between a lower front portion of the rear wheel tire 79 and the driven friction wheel 77 at 164 in the direction of a radial line 166 intersecting a vertical line 168 thorough the rear wheel axis of rotation at an angle of less than 45 degrees with the angle being reduced in accordance with the mounting height of the rear wheel as illustrated in FIG. 2. Various visual gauges, such as a load indicator and/or a velocity indicator 170 may be suitably mounted on the exercise apparatus and connected to the variable load-applying means 22 and/or the rear wheel of the bicycle to indicate load and/or speed.

Figure 7:
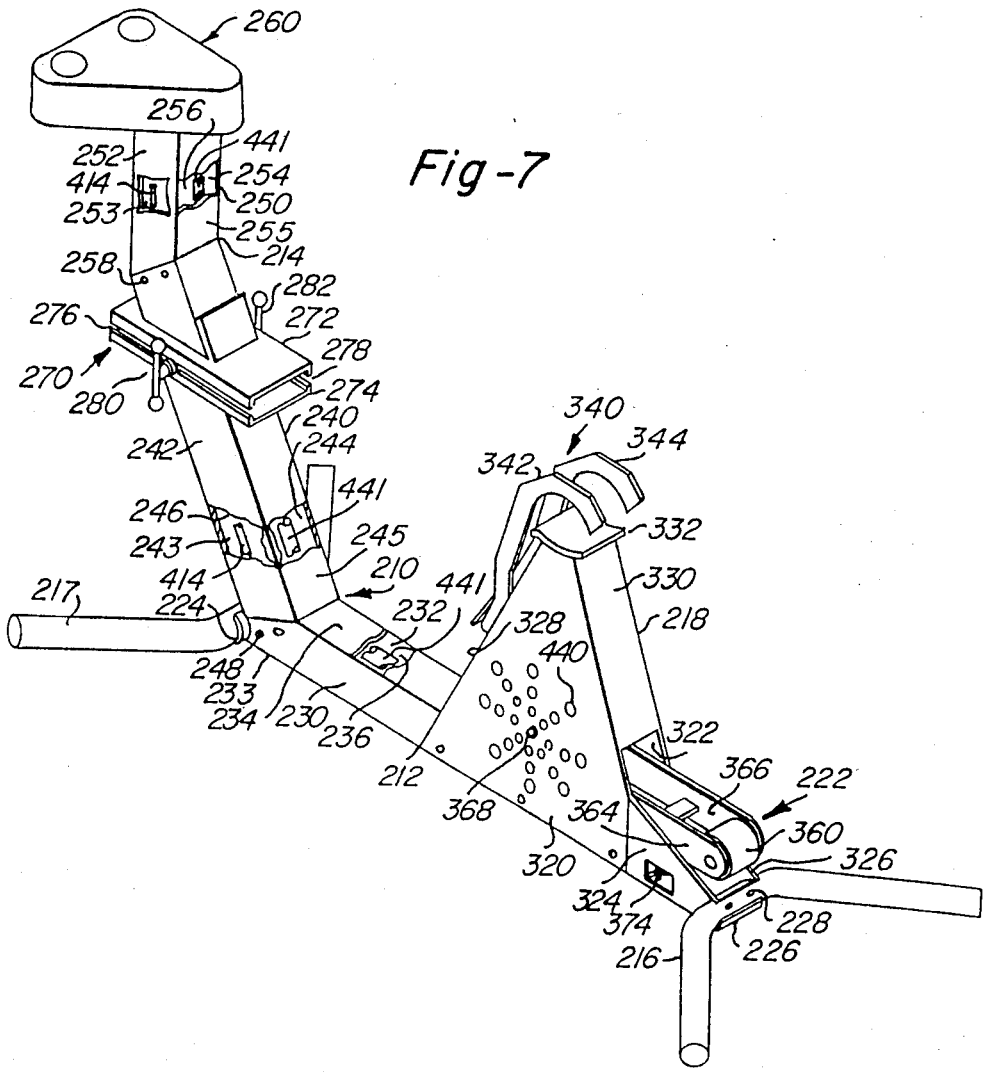
FIG. 7 is a perspective view of another bicycle mounting-type exercise apparatus.
Figure 8:
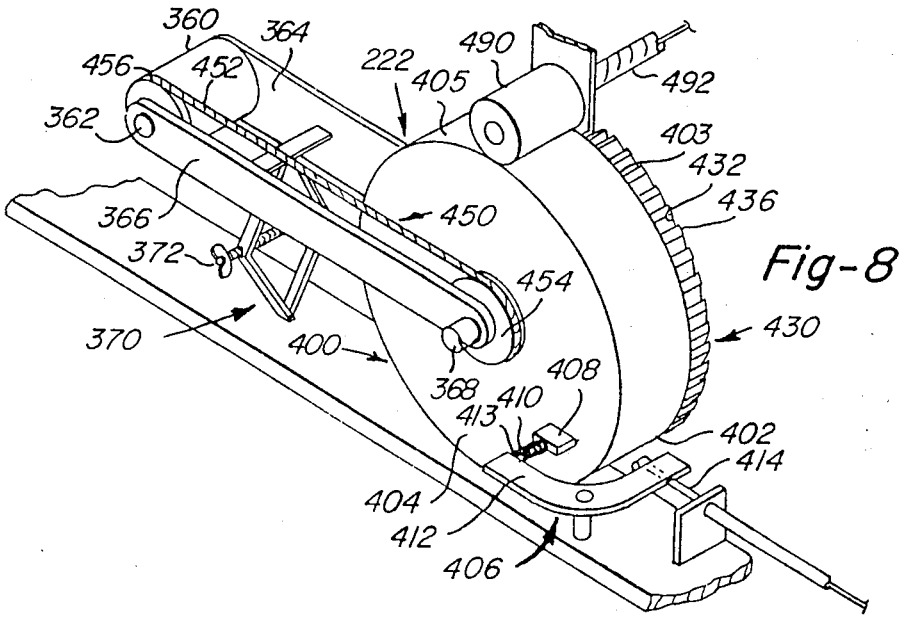
FIG. 8 is an enlarged perspective view of a portion of the apparatus of FIG. 7.

Referring to FIGS. 7–13, in general, the exercise apparatus of another embodiment of the bicycle mounting-type exercise apparatus comprises a stationary support stand means 210 having a m in elongated horizontally extending bottom support means portion 212; an upwardly extending front end support post means portion 214; rear and front laterally extending stabilizer means 216, 217; and a central upwardly extending housing and support means portion 218 for supporting a bicycle (not shown) with the front wheel removed, in a vertical upright attitude as previously described. A variable resistance load-applying means 222, FIG. 8, is mounted within the housing and support means portion 218 for drivable engagement with the rear wheel of a bicycle.

The stand means 210 is preferably made of metallic sheet material such as steel. The stabilizer members 216, 217 are made of one piece of formed tubular metallic material; fixedly removably attached to semi-circular brackets 224, 226 welded on the ends of the bottom support means portion 212 by threaded fasteners 228 or the like to facilitate shipping and storage.

The bottom support means portion 212 comprises a front frame section having a pair of parallel vertically extending side plate members 230, 232 suitably rigidly connected by an elongated lower plate member 233, which may extend the entire length of the bottom support means portion 212, and an upper plate member 234, extending between the support means portions 214, 218, to provide an elongated control passage 236 of polygonal cross-sectional configuration. The front end support means portion 214 comprises an upwardly outwardly inclined lower frame section 240 made of rigid side plate members 242, 243, 244, 245 which define an elongated control passage 246 of polygonal cross-sectional configuration. The lower end portion of section 240 is telescopically mounted in the front end portion of the bottom support means portion 212 and suitably rigidly connected thereto as by threaded fasteners 248. The front end support means portion 214 further comprises an upwardly extending upper frame section 250 made of rigidly connected side plate members 252, 253, 254, 255 which define an elongated control passage 256 of polygonal cross-sectional configuration. The lower end portion of section 250 is telescopically mounted in the upper end portion of lower section 240 and rigidly connected thereto by suitable threaded fasteners 258. An instrument panel housing means 260 is suitably mounted on the upper end portion of upper section 250.

Figure 11:
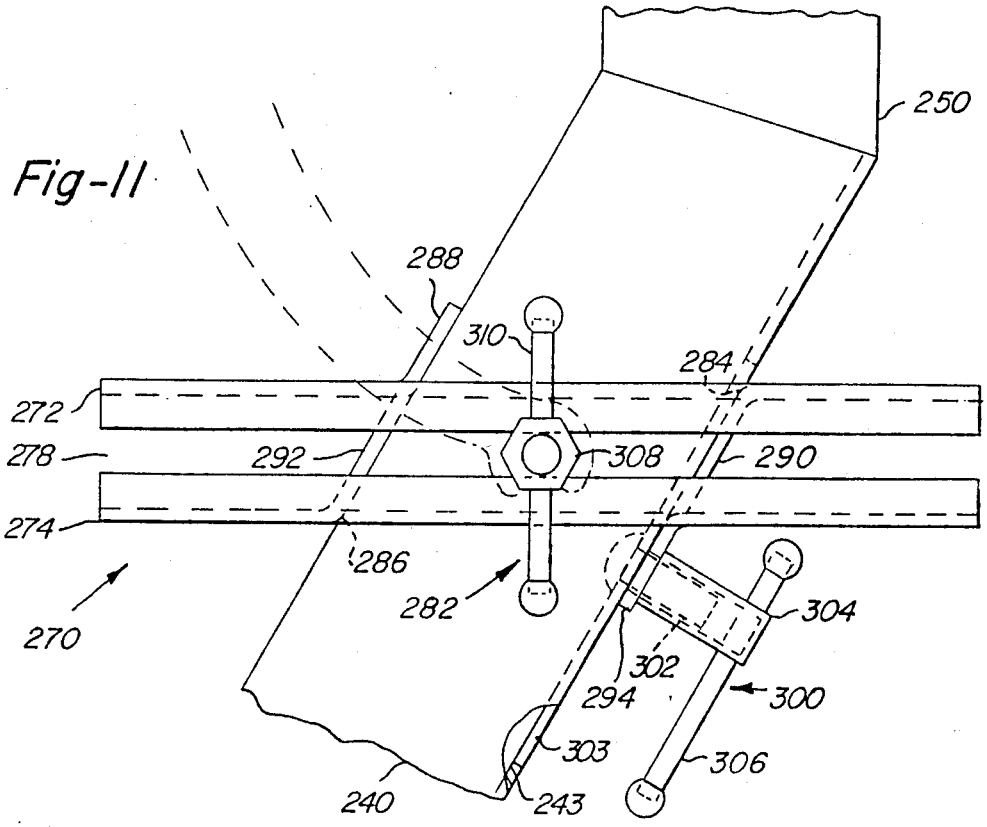
FIG. 11 is an enlarged side elevational view of a portion of the apparatus of FIG. 7.
Figure 12:
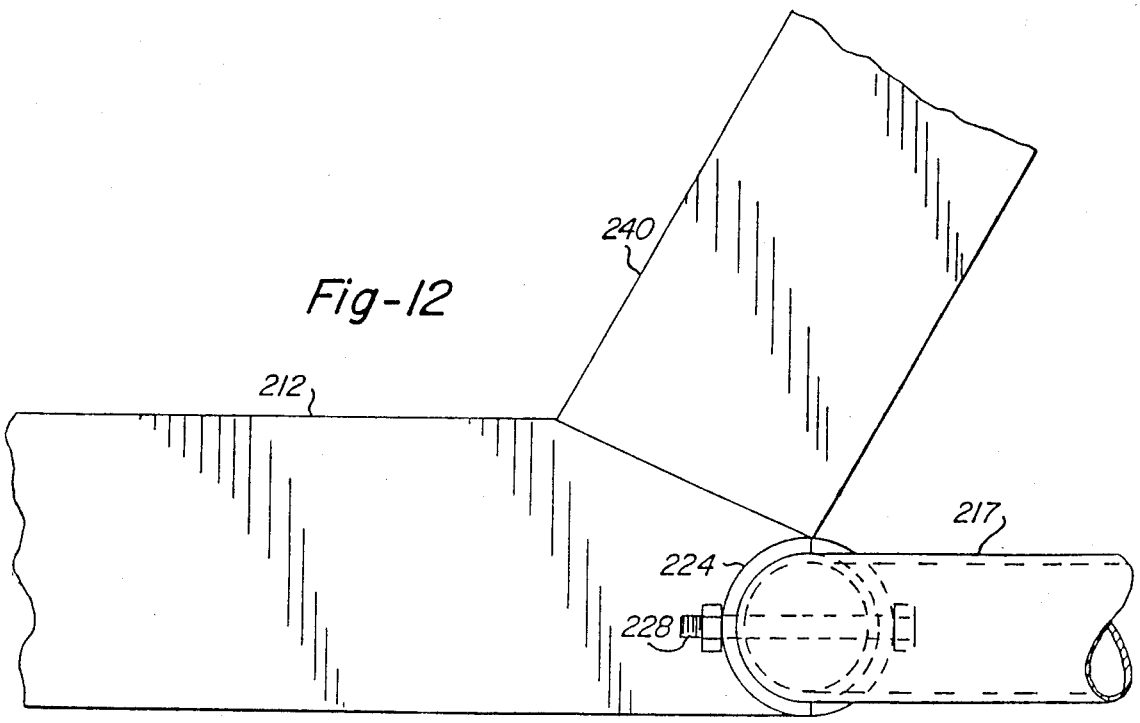
FIG. 12 is another enlarged side elevational view of another portion of the apparatus of FIG. 7.

An adjustable front wheel fork mounting means 270 is slidably adjustably mounted on the upper end portion of lower section 240 for receiving and rigidly supporting the lower end of the fork of a bicycle with the front wheel removed as illustrated in FIG. 11. The mounting means 270 comprises upper and lower channel shaped plate members 272, 274 mounted in fixed spaced relationship to define a pair of opposite elongated parallel guide slots 276, 278, FIG. 7, in which releasable and tightenable fork attachment and support means 280, 282 are slidably adjustably retained. As shown in FIG. 11, each of the plate members 272, 274 is provided with a central opening 284, 286 of polygonal configuration corresponding to the polygonal configuration of lower section 240. The openings 284, 286 are defined by opposite pairs of upwardly and downwardly turned inclined integral flange portions 288, 290 and 292, 294, respectively, which slidably abutably support the mounting means 270 on section 240 with flange portions 290, 292 being suitably fixedly connected to members 274, 272, respectively, as by welding. Vertical height adjustment and clamping means 300 are provided by a threaded fastener 302 slidably adjustably mounted in an elongated slot 303 in plate member 243 and a threaded nut device 304 operable by a handle member 306 to accommodate different size bicycles. The lateral adjustment means 280, 282 comprise similar nut members slidably mounted in slots 276, 278 with a threaded nut device 308 being operable by a handle member 310.

Figure 13:
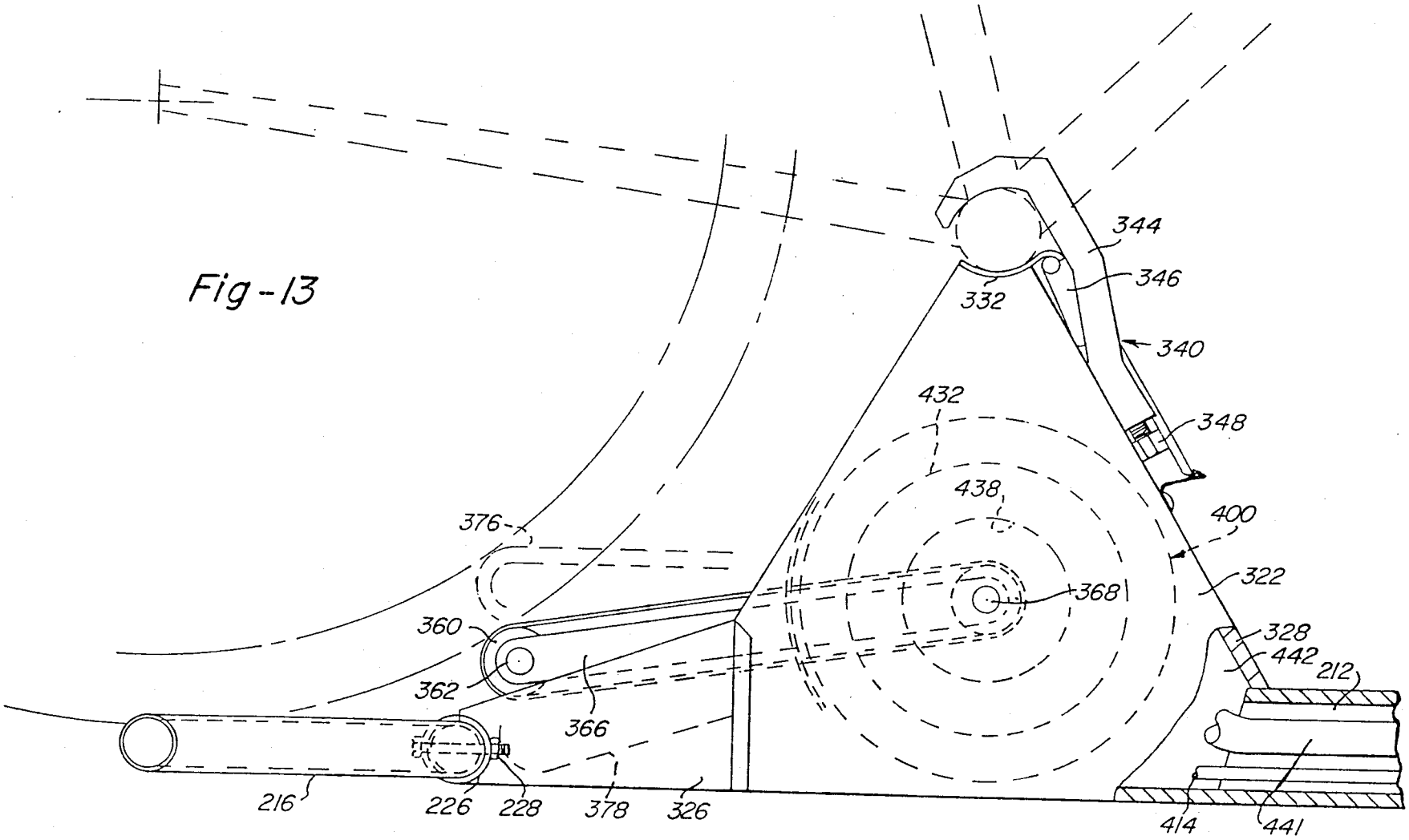
FIG. 13 is an enlarged side elevational view, partly in cross-section, of another portion of the apparatus of FIG. 7.

The central housing and support means portion 218 comprises a pair of spaced parallel generally triangular-shape side plate members 320, 322 having rearwardly extending generally triangular shape flange portions 324, 326 to which rear stabilizer means 216 is attached. Plate members 320, 322 are rigidly connected by front and rear end plate members 328, 330 and support an upper cradle plate means 332 for receiving and supporting the crank shaft hub of a bicycle as previously described. A suitable releasable clamping means 340, in the form of a pair of J-shaped clamping plates 342, 344 operable between open and closed clamping positions by suitable cam means 346 and adjustment screw means 348, FIG. 13, is provided for releasably clamping the crank hub portion of the bicycle. The rear end portion of bottom frame means 212 is telescopically received between side plate members 320, 322 and suitably fixedly secured thereto.

As shown in FIGS. 7, 8 & 13, the variable resistance load-applying means 222 comprises a driven wheel means 360 freely rotatably mounted on a shaft 362 supported between spaced parallel elongated rigid arm members 364, 366 selectively pivotally displaceably mounted on a shaft member 368 in housing portion 218. Wheel member adjustment means 370, in the form of a conventional scissors-type jack device, are mounted beneath and operably connected to the arm members 364, 366 to enable variable adjustment by a threaded device 372, accessible through an opening 374 in rear flange portion 324, between upper and lowermost positions 376, 378 illustrated in FIG. 13 to accommodate different size bicycles and to obtain desired frictional engagement between the bicycle tire and driven wheel member 360.

The flywheel means 400 is suitably centrally rotatably mounted on shaft member 368, opposite ends of which are suitably mounted in side plate members 320, 322, for simulating the momentum forces encountered during actual bicycle riding. The flywheel means 400 of the preferred embodiment comprises a cylindrical member 402 of steel o the like, having a suitable size and weight to effect the desired results, with flat annular side surfaces 403, 404 and an annular peripheral surface 405.

As shown in FIG. 8, a selectively adjustable resistance load-applying means, in the form of a frictional motion retarding means 406, is associated with the flywheel member 402 to enable selective adjustment of resistance load applied to the rear wheel of the bicycle. The motion retarding means 406 comprises a frictional braking pad device 408 mounted on a slidable shaft member 410 carried at one end of a pivotally displaceable arm member 412 for rotative displacement relative to flywheel surface 404 to cause variable retarding engagement of friction pad 408 therewith. A compression spring 413 is mounted circumjacent shaft 410 to bias the pad device 408 toward engagement with surface 404 and enable relative movement between the pad device and the operating arm 412 which is selectively adjustably actuatable by an adjustment control device such as a cable 414 or the like extending to the instrument panel through the frame portions 212, 214.

The variable resistance load-applying means 222 further comprises speed responsive resistance load-changing means 30, FIG. 13, for automatically increasing and decreasing the resistance load applied to the driven wheel means in accordance with the rotational speed of the rear wheel. The load changing means 430 may comprise a cage type rotary air blower 432 of generally conventional design as previously described or other fluid impeller means such as a conventional fluid pump. In the presently preferred embodiment, the fluid impeller means is integrally associated with the flywheel member 402 on the annular side thereof opposite the flat side surface 404 with impeller blade members 436 peripherally mounted around an air induction chamber 438, FIG. 13, connected to atmosphere through air inlet openings 440, FIG. 7, in side plate 320. The air blower 432 is peripherally enclosed by suitable housing means (not shown). The construction and arrangement of the blade members 436 is such as to provide variable resistance to rotation of the flywheel member 402 which is proportional to the rotational speed thereof to simulate air resistance when actually riding a bicycle. In addition, if desired, the frame passages or a length of tubing 441 extending to the instrument panel through frame portions 212, 214 may be suitably connected to an air chamber 442 provided in the front lower part of housing means 218 to provide a flow of air to an air outlet 444 in the instrument panel housing in front of the rider simulating the air flow during actual bicycle riding.

The flywheel means 400 is rotatably driven by the wheel driven member 360 through flywheel drive means 450 in the form of a belt 452, a pulley member 454 mounted on shaft 368 and operably connected to flywheel member 402, and a pulley-like annular groove 456 in the periphery of member 360.

Referring now to FIG. 9, the selectively adjustable variable resistance load-applying means 406 is selectively operably connected to control means 460 mounted in instrument panel housing 260 by cable 414. The control means 460 comprises a shaft member 462 rotatably mounting a ratchet wheel member 464, a pulley member 466 having the cable wire member 468 connected thereto, a ratchet pawl device 470 and a drum member 472. A control lever 474 or the like is operably connected to the pulley member 466 to enable the bicycle rider to wind and unwind the cable member 468 on the pulley member 466 to thus selectively change the resistance load applied by the variable loading means 406. The drum member 472 rotates with the pulley member and is provided with indicia means on the periphery thereof calculated, constructed and arranged to display variable grade (hill slope) power output characteristics for the rider on the instrument panel in conjunction with a conventional speedometer means 474. As shown in FIG. 10, the indicia means comprises hill-slope percentage indicia 476 which indicates the resistance load applied by variable loading means 406 in direct proportion to the resistance encountered during actual bicycle riding when going up a particular grade inclined terrain. The power output characteristics displayed are pre-calculated kilo calories per hour indicia 478 and horsepower generated indicia 480 for each percentage slope variation position at five mile per hour speed increments between 0 and 50 miles per hour. The power output characteristic indicia for each speed are arranged in vertical columns 482, 484, etc., identified with the appropriate speed by connecting indicia 486, 488, etc., and in horizontal columns 478, 480 so as to increase from eft to right in accordance with speed of rotation. Since the drum 472 is mounted in juxtaposition to the speedometer means 474, the correlation between the power output characteristics indicia and the speedometer indicia may be accomplished in a relatively simple manner. The speedometer means 474 is driven by a mechanical friction-operated speedometer drive means including a friction driven roller member 490, FIG. 8, suitably mounted in engagement with the peripheral surface 405 of the flywheel member 402 and a conventional speedometer drive cable 492 extending through frame portions 212, 214 to the speedometer housing means. The speedometer means 474 may also preferably include conventional revolutions per minute and odometer means as illustrated in FIG. 10. The instrumentation panel housing means may include other instrumentation such as a conventional timer means 494, a heart rate monitor (not shown) and a maximum target heart rate selector means 496 comprising a rotatable drum member 498 operable by a thumb wheel 500 to select a column corresponding to the age of the rider with maximum target heart rate indicia being indicated in association therewith.

Figure 14:
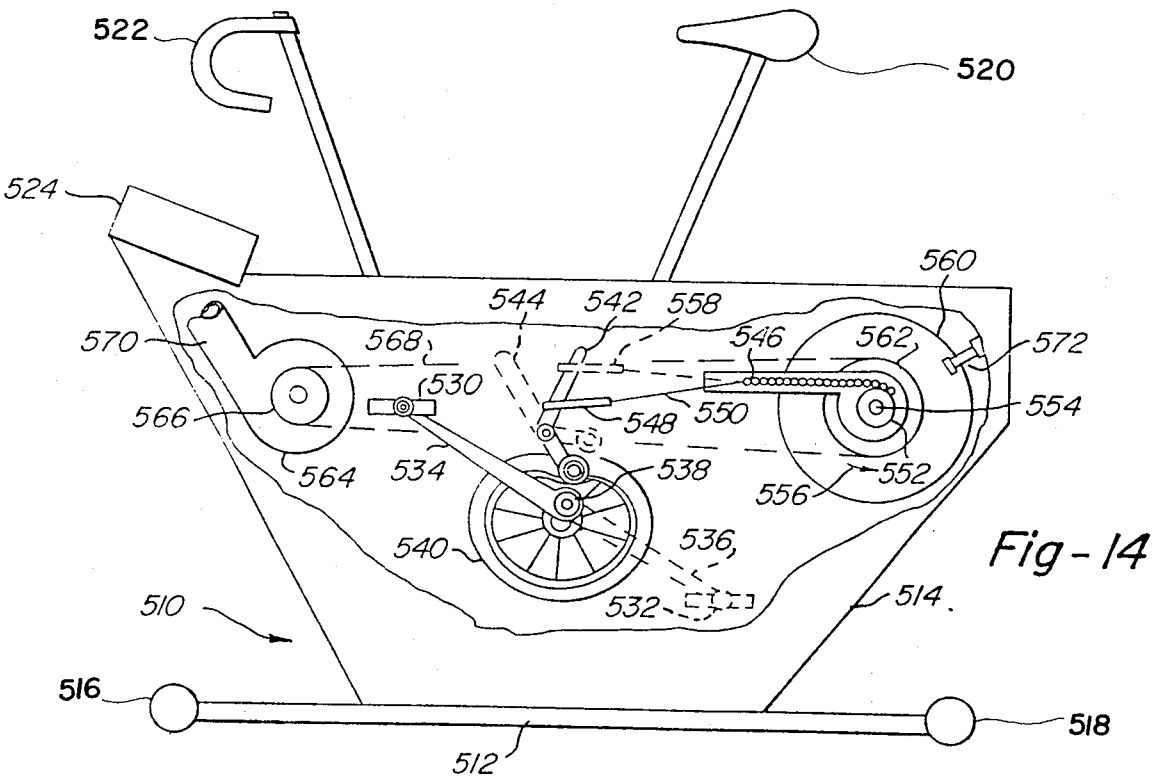
FIG. 14 is a side elevational view, with portions removed, of a self-contained type of exercise apparatus.

Referring now to FIG. 14, an illustrative embodiment of self-contained exerciser apparatus is shown to comprise stationary support frame means 510 having an elongated horizontally extending bottom support member 512; an upwardly extending housing 514; front and rear laterally extending stabilizer members 516, 518; seat and handle bar apparatus 520, 522 suitably mounted on and extending above the housing 514; an instrument housing 524, similar to instrument housing 260 of FIGS. 7–13, suitably mounted on the front end of housing 514. An infinitely variable speed bicycle drive system of the type described in my prior U.S. Pat. No. 4,133,550 is suitably mounted in housing 514 and comprises pedal means 530, 532 on rotatable crank arm means 534, 536 operably connected to a crank shaft 538. Each pedal and crank arm has a cam member 540 (only one of which is shown) operatively associated therewith. Each cam member drives an associated oscillator member 542, 544. Each oscillator member is connected to a drive chain 546 by an adjustable positionable connecting slide member 548 and a pull rod or wire member 550. Each chain member is operatively connected to a one way drive clutch device 552 which drives a rotatable shaft 554 in the direction of arrow 556. The velocity of shaft 554 is variable relative to the velocity of the crank arms and shaft by selective radial adjustment of the slide connectors on the oscillator arms by suitable control means (not shown) between a radially innermost low gear position shown by connector 548 in FIG. 14 and a radially outermost high gear position shown in phantom at 558. Additional speed multiplicator means (not shown) may be utilized as described in my prior patent.

A flywheel means 560 and a pulley means 562 are mounted on and connected to shaft 554 for rotation therewith. A variable resistance load-applying fan means 564 and drive pulley means 566 are mounted at the front end of housing 514. A drive belt 568 driveably connects pulley means 562 & 566. The outlet 570 of fan means 560 is connected by suitable passage means to air outlet means (not shown) in the instrument housing as previously described. A selectively adjustable fixed resistance load-applying means 572 is suitably associated with the flywheel means as previously described and suitable controls (not shown) are connected thereto.

In operation, the flywheel means is continuously rotated by the bicycle drive system for energy storage to simulate inertial forces involved in the actual riding of a bicycle. The design characteristics of the flywheel means are such as to provide for energy storage approximating the actual inertial forces caused by the combined weight of a rider and a bicycle at particular riding velocities. For example, assuming a combined weight of 180 pounds, the flywheel member 402 has a diameter of approximately 8 inches, a width of 1 inch, and a mass of approximately 14 pounds with a minimum flywheel-crank arm velocity ratio of approximately 50:1. The inertial design characteristics of the flywheel means of the present invention may be varied in accordance with a particular rider and bicycle weight to be matched, such as for example, between approximately 75 pounds or less for a child to 275 pounds or more for an adult, while still resulting in the provision of relatively high energy storage flywheel means of relatively small size. The arrangement and construction is specially calculated and designed to provide an automatically variable relatively high inertial force continuously uniformly applied to the bicycle drive system while being continuously variable in direct relationship to the rotational velocity of the drive system for relatively closely approximately simulating the actual inertial forces generated by a bicycle rider during actual riding of a bicycle.

The automatically continuously variable resistance load-applying means is also continuously rotated by the drive system of the exercise apparatus. The arrangement and construction is specifically calculated and designed to provide an automatically variable resistance force continuously effective on the drive system and being continuously variable in direct relationship to the rotational velocity of the drive system for relatively closely approximating actual resistance forces encountered by a bicycle rider during actual riding of a bicycle. The calibration and design may be based upon actual wind tunnel test results as to actual air resistance forces encountered during actual riding of a bicycle.

In addition, the selectively variable resistance load means is continuously operatively associated with the drive system of the exercise apparatus. The arrangement and construction is specifically calculated and designed to provide a selectively variable resistance force effective on the drive system for further relatively closely approximating the actual resistance forces encountered by a bicycle rider during actual variable grade downhill and uphill bicycle riding conditions. The construction and arrangement of the braking apparatus 406, in conjunction with the automatically continuously variable resistance load means is such as to provide a combined resistance force which may be selectively varied to be equivalent to 0 degrees (i.e. level terrain) slope actual bicycle riding resistance characteristics or various uphill, (e.g. +10 degrees slope) and, if desired, may be constructed and arranged to also provide downhill (e.g. −10 degrees slope) actual bicycle riding resistance characteristics, the brake pad 408 being in resistive engagement with flywheel surface 404 at the 0 degrees slope condition with the amount of resistive engagement being selectively increased for positive slope condition and decreased for negative slope conditions.

During operation of the drive system, the exercise conditions and results are accurately visually displayed under all simulated actual bicycle riding conditions including velocity attained and power exerted and calories expended by the rider at all velocities. In addition, the instrumentation may include timing devices, heart rate monitor apparatus, target heart rate information, and body cooling air flow apparatus.

The apparatus is further constructed and arranged to (a) enable the use of variable size and style bicycles; (b) reduce size and cost of manufacture; (c) enable use of any variable speed bicycle drive apparatus and (d) enable accurate simulation of actual bicycle riding characteristics in any speed provided by such apparatus. While one specific purpose is to enable stationary exercise by bicycle riders for the purpose of conditioning and training for actual bicycle riding, another important purpose and result is to enable more satisfactory and healthful exercise by all persons for general exercise purposes and for special health rehabilitation purposes. The apparatus enables permanent calibration of instruments and exercise results display apparatus, which are substantially unaffected by rotational speed, temperature and wear, etc., exercise results displayed with both the speedometer means and the power and calorie display means being directly mechanically connected to the exercise apparatus whereby the results displayed are very accurate under all conditions of usage.

In actual riding of a bicycle, the speed of movement and the work required by the rider are a function of the total amount of resistance to movement forces encountered under particular riding conditions. Total resistance to movement force is a function of inertial resistance force, inherent bicycle drive system resistance force, wheel-ground resistance force and air resistance force. The work required by the rider is a function of total resistance force, mechanical advantage of the bicycle drive system and momentum forces. Inertial resistance and momentum forces are a function of rider and bicycle weight. Resistance forces and momentum forces are variable depending upon weather conditions, road conditions and terrain, e.g., flat, uphill or, if desired, downhill. In order to provide exercising apparatus which will enable relatively close approximation of actual bicycle riding conditions, each of these variable factors should be taken into consideration.

In the present invention, each of these factors are accounted for by the provision of flywheel means for simulating inertial resistance and momentum forces at varying rotational speeds; variable resistance means for simulating resistance to movement at varying rotational speeds; and variable speed drive means for driving the flywheel means and the variable resistance means at selectable speeds, the flywheel means and the variable resistance means being calibrated and designed to simulate actual selectable riding conditions at varying rotational speeds.

In the aforedescribed embodiments of the invention, the flywheel means comprises a relatively small size and weight flywheel device which is driven at relatively high velocities to simulate inertial resistance and momentum forces of a rider and bicycle having a weight of 180 pounds. The variable resistance means comprises an automatically variable resistance device, preferably involving acceleration of mass such as air by a rotary fan or other fluid by a fluid pump, which is calibrated and designed to provide variable increasing resistance forces proportional to variable increasing rotational speeds to thereby simulate changes in resistance encountered during actual bicycle riding. The variable resistance means also comprises a variably adjustable resistance device which provides a fixed resistance at all rotational speeds to enable simulation of variations in wheel-ground resistance and ground level variations which may be encountered during actual bicycle riding.

Thus the present invention provides exerciser apparatus which may very closely simulate actual infinitely variable bicycle riding conditions as selected by the exerciser.

In operation, the exerciser may choose to exercise at any desired rotational speed corresponding to any riding velocity to be simulated in any selected gear ratio enabled by whichever type variable speed drive system is available on a bicycle associated with the apparatus of FIGS. 1–13 or built into the apparatus of FIG. 14. The components of the exercise system are calibrated, constructed and designed so that certain velocity related forces and resistances are automatically simulated and certain ground related forces and resistances may be selectively simulated.

The automatically variable resistance force applying means involves the principle of mass acceleration proportional to rotational velocity of the drive system. In use of the air impeller unit, air is forced through the unit by the impeller blades at a velocity and with resistance to air flow which are proportional to the velocity of the drive system associated therewith. Thus, a mass of air is continuously accelerated by the impeller blades during rotational movement thereof to provide resistance by mass acceleration friction and turbulence. As the rotational speed of the impeller blades changes, so too will the rate of movement of air, as well as the resistance force provided thereby, be variably proportionately changed.

The amount of resistance to air flow is dependent upon the design and construction of the impeller unit. The design and construction of the impeller blades may be modified as necessary or desirable and adjustable blades may be used to enable selective variable adjustment thereof by the exerciser. In addition or alternatively, the design and construction of the air passages may be modified as necessary or desirable and adjustable flow control means may be used to enable selective variable adjustment thereof by the exerciser. The design and construction of the prior described illustrative embodiments of the invention have been based upon prior published wind tunnel test results which are incorporated herein by reference and accompanied my prior application. While fluid flow devices, air or liquid, are presently preferred, any device capable of providing mass acceleration and variable resistance to movement instantaneously proportional to changes in velocity of the drive system may be used.

The flywheel means involves the principle of high speed rotation of a relatively small size and weight mass in direct substantially increased proportion to rotational velocity of the drive system. The size, weight and required increase in rotational velocity of the flywheel means may be calculated in accordance with the following principles:

1. Kinetic energy is equal to $\frac{1}{2}$ the mass times the velocity squared.

2. If a disc type mass is used, rotational energy equals ½ the moment of inertia times the square of rotational velocity in radians per second.
3. Sample calculations will show that in order to be able to utilize a relatively small size and weight mass, a relatively high rotational velocity must be utilized.

For example, in order to simulate the momentum characteristics of an 180 pound rider-bicycle weight at 15 and 25 miles per hour with a 1:1 velocity ratio basis between the drive system and the flywheel means, flywheel weights of approximately 4100 pounds and 6900 pounds, respectively, would be required. On the other hand, by use of an 80:1 increase in velocity ratio between the drive system and a disc type flywheel means having a diameter of only approximately 8 inches, a width of only approximately 1 inch, and a weight of only approximately 14 pounds, will substantially simulate an 180 pound rider-bicycle weight.

The maximum weight of the flywheel means should not exceed approximately 50 pounds and, preferably, should be between approximately 5 and 20 pounds. The size, shape and weight of the flywheel is variable dependent upon the amount of the speed increase between the crank arms and the flywheel means but the diameter of the flywheel means should not exceed 30 inches. The speed increase ratio between the crank arms and the flywheel means is variable dependent upon the size, shape and weight of the flywheel; but the preferred minimum speed increase ratio for both the bicycle mounting type exerciser of FIGS. 1–13 and the self-contained type exerciser of FIG. 14 is at least approximately 40:1 or more to achieve best results, although a minimum ratio of not less than 10:1 for the bicycle mounting-type exerciser in particular may be used to achieve minimum desired results. In any event, the moment of inertia should be between a maximum of approximately 3.0 pounds feet seconds squared with 0.06 pounds feet seconds squared being presently preferred in the embodiment of FIGS. 15–22; approximately 0.2 pounds feet seconds squared being presently preferred in the embodiment of FIG. 14 and approximately 0.02 pounds feet seconds squared being presently preferred in the embodiments of FIGS. 1–13.

The following Tables A, B, and C show the characteristics and parameters of exercise apparatus constructed and arranged in accordance with the present invention. Table A represents total energy stored in the system and power values of a presently preferred embodiment of the invention. Table B represents high and low energy storage and power values, respectively, of the range of such values within which the invention may be practiced. Table C shows incremental percentage change of requirements for high and low values of Table B. The values of each table are generic to all types of exercise apparatus which employ the invention. Column 1 of each table represents gradually increased levels of exercise from a lowest level 1 to a highest level 50 which are generally equivalent to ground speeds measured in terms of miles per hour (MPH) in connection with bicycle-type exercises as may be performed on a stationary bicycle-type exercise device. Tables A and B (Total Energy Level LB-FT) show the amount of energy in foot-pounds stored in the exercise apparatus, including the Energy Storage and Dissipation apparatus, at successively increased levels of exercise (e.g. level 5 or 5 mph, level 10 or 10 mph, level 20 or 20 mph, etc.). Tables A and B (Power LB-FT/Sec to Reach Next Level) also show the amount of power required to increase the stored energy level from one level of exercise to another level of exercise, (e.g. 9 to 10, 15 to 16, 30 to 31 etc.). Tables A and B (Power LB-FT/SEC to Maintain Present Level) also show the amount of power required to maintain operation of the exercise apparatus at each level of exercise. For example, at the 20 level of exercise of Table A, total energy stored in the exercise apparatus is approximately 1279 foot-pounds and approximately 107 foot-pounds per second of power (column 4) is required to maintain the 20 level of exercise. In addition, column 3 of Table A shows that approximately 213 foot-pounds per second of power is required to increase the level of exercise from the 20 level to the 21 level of exercise. Table B shows that at the 20 level of exercise, beneficial results of the present invention are obtainable in a range of values between approximately a low value of 639 to a high value of 2558 pounds-feet total stored energy level (Columns 2 and 3), between approximately 107 to 426 pounds-feet per second power to reach the next 21 level of exercise (Columns 4 and 5), and between approximately 53 to 213 pounds-feet per second power to maintain the 20 level of exercise (Columns 6 and 7). Table C shows the incremental changes in percentage of total energy level and power input required to maintain a level of exercise and to change from one level of exercise to the next level of exercise for the high and low ranges of Table B.

TABLE A

CURRENTLY PREFERRED EMBODIMENT
This Table displayes the relationships between the TOTAL ENERGY LEVEL stored in the ENERGY STORAGE & DISSIPATION DEVICE, the RATE OF ENERGY INPUT (POWER) needed to reach the next listed total energy level, and the POWER needed to maintain (overcome resistance) at a given energy level. SPEED is the equivalent of road speed if used with a bicycle type exerciser.

| LEVEL MPH SPEED | TOTAL ENERGY LEVEL (LB-FT) | POWER (LB-FT/SEC) TO REACH NEXT LEVEL | POWER (LB-FT/SEC) TO MAINTAIN PRESENT LEVEL |
|---|---|---|---|
| 1 | 3 | 2 | 1 |
| 2 | 13 | 5 | 2 |
| 3 | 29 | 7 | 4 |
| 4 | 51 | 10 | 5 |
| 5 | 80 | 14 | 7 |
| 6 | 115 | 17 | 9 |
| 7 | 157 | 21 | 11 |
| 8 | 205 | 28 | 14 |
| 9 | 259 | 36 | 18 |
| 10 | 320 | 47 | 23 |
| 11 | 387 | 57 | 28 |
| 12 | 460 | 67 | 34 |
| 13 | 540 | 79 | 40 |
| 14 | 627 | 93 | 46 |
| 15 | 719 | 108 | 54 |
| 16 | 818 | 125 | 62 |
| 17 | 924 | 144 | 72 |
| 18 | 1036 | 165 | 82 |
| 19 | 1154 | 188 | 94 |
| 20 | 1279 | 213 | 107 |
| 21 | 1410 | 241 | 120 |
| 22 | 1547 | 271 | 136 |
| 23 | 1691 | 304 | 152 |
| 24 | 1841 | 339 | 170 |
| 25 | 1998 | 378 | 189 |
| 26 | 2161 | 419 | 209 |
| 27 | 2331 | 464 | 232 |
| 28 | 2506 | 511 | 255 |
| 29 | 2689 | 562 | 281 |
| 30 | 2877 | 616 | 308 |
| 31 | 3072 | 674 | 337 |
| 32 | 3274 | 736 | 368 |

TABLE A-continued

CURRENTLY PREFERRED EMBODIMENT
This Table displayes the relationships between the TOTAL ENERGY LEVEL stored in the ENERGY STORAGE & DISSIPATION DEVICE, the RATE OF ENERGY INPUT (POWER) needed to reach the next listed total energy level, and the POWER needed to maintain (overcome resistance) at a given energy level. SPEED is the equivalent of road speed if used with a bicycle type exerciser.

| LEVEL MPH SPEED | TOTAL ENERGY LEVEL (LB-FT) | POWER (LB-FT/SEC) TO REACH NEXT LEVEL | POWER (LB-FT/SEC) TO MAINTAIN PRESENT LEVEL |
|---|---|---|---|
| 33 | 3481 | 801 | 401 |
| 34 | 3696 | 871 | 435 |
| 35 | 3916 | 944 | 472 |
| 36 | 4143 | 1022 | 511 |
| 37 | 4377 | 1103 | 552 |
| 38 | 4616 | 1190 | 595 |
| 39 | 4862 | 1280 | 640 |
| 40 | 5115 | 1376 | 688 |
| 41 | 5374 | 1476 | 738 |
| 42 | 5639 | 1581 | 790 |
| 43 | 5911 | 1691 | 845 |
| 44 | 6189 | 1806 | 903 |
| 45 | 6474 | 1926 | 963 |
| 46 | 6765 | 2052 | 1025 |
| 47 | 7062 | 2182 | 1091 |
| 48 | 7366 | 2319 | 1159 |
| 49 | 7676 | 2461 | 1230 |
| 50 | 7992 | 2610 | 1304 |

*END*

TABLE B

HIGH AND LOW BOUNDRIES OF THE DESIGN ENVELOPE
This table displayes the relationships between the TOTAL ENERGY LEVEL stored in the ENERGY STORAGE & DISSIPATION DEVICE, the RATE OF ENERGY INPUT (POWER) needed to reach the next listed total energy level, and the POWER needed to maintain (overcome resistance) at a given energy level. SPEED is the equivalent of road speed if used with a bicycle type exerciser.

| LEVEL MPH SPEED | TOTAL ENERGY LEVEL (LB-FT) LOW | TOTAL ENERGY LEVEL (LB-FT) HIGH | POWER (LB-FT/SEC) TO REACH NEXT LEVEL LOW | POWER (LB-FT/SEC) TO REACH NEXT LEVEL HIGH | POWER (LB-FT/SEC) TO MAINTAIN PRESENT LEVEL LOW | POWER (LB-FT/SEC) TO MAINTAIN PRESENT LEVEL HIGH |
|---|---|---|---|---|---|---|
| 1 | 2 | 6 | 1 | 5 | 1 | 2 |
| 2 | 6 | 26 | 2 | 10 | 1 | 5 |
| 3 | 14 | 58 | 4 | 15 | 2 | 7 |
| 4 | 26 | 102 | 5 | 21 | 3 | 10 |
| 5 | 40 | 160 | 7 | 27 | 3 | 14 |
| 6 | 58 | 230 | 9 | 34 | 4 | 17 |
| 7 | 78 | 313 | 11 | 43 | 5 | 21 |
| 8 | 102 | 409 | 14 | 56 | 7 | 28 |
| 9 | 129 | 518 | 18 | 73 | 9 | 36 |
| 10 | 160 | 639 | 23 | 93 | 12 | 46 |
| 11 | 193 | 774 | 28 | 113 | 14 | 57 |
| 12 | 230 | 921 | 34 | 134 | 17 | 67 |
| 13 | 270 | 1081 | 40 | 158 | 20 | 79 |
| 14 | 313 | 1253 | 46 | 186 | 23 | 93 |
| 15 | 360 | 1439 | 54 | 216 | 27 | 108 |
| 16 | 409 | 1637 | 63 | 250 | 31 | 125 |
| 17 | 462 | 1848 | 72 | 288 | 36 | 144 |
| 18 | 518 | 2072 | 82 | 330 | 41 | 165 |
| 19 | 577 | 2308 | 94 | 376 | 47 | 188 |
| 20 | 639 | 2558 | 107 | 426 | 53 | 213 |
| 21 | 705 | 2820 | 120 | 482 | 60 | 241 |
| 22 | 774 | 3095 | 136 | 542 | 68 | 271 |
| 23 | 846 | 3382 | 152 | 608 | 76 | 304 |
| 24 | 921 | 3683 | 170 | 679 | 85 | 339 |
| 25 | 999 | 3996 | 189 | 756 | 94 | 378 |
| 26 | 1081 | 4322 | 210 | 838 | 105 | 419 |
| 27 | 1165 | 4661 | 232 | 927 | 116 | 463 |
| 28 | 1253 | 5013 | 256 | 1022 | 128 | 511 |
| 29 | 1344 | 5377 | 281 | 1124 | 140 | 562 |
| 30 | 1439 | 5754 | 308 | 1233 | 154 | 616 |
| 31 | 1536 | 6144 | 337 | 1349 | 169 | 674 |

TABLE B-continued

HIGH AND LOW BOUNDRIES OF THE DESIGN ENVELOPE
This table displayes the relationships between the TOTAL ENERGY LEVEL stored in the ENERGY STORAGE & DISSIPATION DEVICE, the RATE OF ENERGY INPUT (POWER) needed to reach the next listed total energy level, and the POWER needed to maintain (overcome resistance) at a given energy level. SPEED is the equivalent of road speed if used with a bicycle type exerciser.

| LEVEL MPH SPEED | TOTAL ENERGY LEVEL (LB-FT) LOW | TOTAL ENERGY LEVEL (LB-FT) HIGH | POWER (LB-FT/SEC) TO REACH NEXT LEVEL LOW | POWER (LB-FT/SEC) TO REACH NEXT LEVEL HIGH | POWER (LB-FT/SEC) TO MAINTAIN PRESENT LEVEL LOW | POWER (LB-FT/SEC) TO MAINTAIN PRESENT LEVEL HIGH |
|---|---|---|---|---|---|---|
| 32 | 1637 | 6547 | 368 | 1472 | 184 | 736 |
| 33 | 1741 | 6963 | 401 | 1603 | 200 | 801 |
| 34 | 1848 | 7391 | 435 | 1742 | 218 | 871 |
| 35 | 1958 | 7832 | 472 | 1888 | 236 | 944 |
| 36 | 2072 | 8286 | 511 | 2043 | 255 | 1021 |
| 37 | 2188 | 8753 | 552 | 2207 | 276 | 1103 |
| 38 | 2308 | 9233 | 595 | 2379 | 297 | 1189 |
| 39 | 2431 | 9725 | 640 | 2561 | 320 | 1280 |
| 40 | 2557 | 10230 | 688 | 2751 | 344 | 1375 |
| 41 | 2687 | 10748 | 738 | 2952 | 369 | 1475 |
| 42 | 2820 | 11279 | 790 | 3161 | 395 | 1580 |
| 43 | 2956 | 11822 | 845 | 3381 | 423 | 1690 |
| 44 | 3095 | 12378 | 903 | 3611 | 451 | 1805 |
| 45 | 3237 | 12947 | 963 | 3852 | 481 | 1925 |
| 46 | 3382 | 13529 | 1026 | 4103 | 513 | 2051 |
| 47 | 3531 | 14124 | 1091 | 4365 | 545 | 2182 |
| 48 | 3683 | 14731 | 1160 | 4638 | 580 | 2318 |
| 49 | 3838 | 15351 | 1231 | 4923 | 615 | 2461 |
| 50 | 3996 | 15984 | 1305 | 5219 | 652 | 2609 |

*END*

TABLE C

HIGH AND LOW BOUNDRIES OF THE DESIGN ENVELOPE
This table displayes the relationships between the TOTAL ENERGY LEVEL stored in the ENERGY STORAGE & DISSIPATION DEVICE, the RATE OF ENERGY INPUT (POWER) needed to reach the next listed total energy level, and the POWER needed to maintain (overcome resistance) at a given energy level. SPEED is the equivalent of road speed if used with a bicycle type exerciser.

| ENERGY LEVEL MPH SPEED | INCREMENTAL CHANGE, in %, LEVEL TO LEVEL, OF: TOTAL ENERGY LEVEL (LB-FT) LOW | TOTAL ENERGY LEVEL (LB-FT) HIGH | POWER (LB-FT/SEC) TO REACH NEXT LEVEL LOW | POWER (LB-FT/SEC) TO REACH NEXT LEVEL HIGH | POWER (LB-FT/SEC) TO MAINTAIN PRESENT LEVEL LOW | POWER (LB-FT/SEC) TO MAINTAIN PRESENT LEVEL HIGH |
|---|---|---|---|---|---|---|
| 1 | 100.0 | 100.0 | 100.0 | 100.0 | 100.0 | 100.0 |
| 2 | 75.0 | 75.0 | 50.9 | 50.9 | 50.9 | 50.9 |
| 3 | 55.6 | 55.6 | 35.2 | 35.2 | 35.2 | 35.2 |
| 4 | 43.7 | 43.8 | 27.9 | 27.9 | 27.9 | 27.9 |
| 5 | 36.0 | 36.0 | 23.7 | 23.7 | 23.7 | 23.7 |
| 6 | 30.6 | 30.6 | 21.2 | 21.2 | 21.2 | 21.2 |
| 7 | 26.5 | 26.5 | 19.4 | 19.4 | 19.4 | 19.4 |
| 8 | 23.4 | 23.4 | 24.2 | 24.2 | 24.2 | 24.2 |
| 9 | 21.0 | 21.0 | 22.9 | 22.9 | 22.9 | 22.9 |
| 10 | 19.0 | 19.0 | 21.8 | 21.8 | 21.8 | 21.8 |
| 11 | 17.4 | 17.4 | 17.8 | 17.8 | 17.8 | 17.8 |
| 12 | 16.0 | 16.0 | 15.8 | 15.8 | 15.8 | 15.8 |
| 13 | 14.8 | 14.8 | 15.2 | 15.2 | 15.2 | 15.2 |
| 14 | 13.8 | 13.8 | 14.6 | 14.6 | 14.6 | 14.6 |
| 15 | 12.9 | 12.9 | 14.1 | 14.1 | 14.1 | 14.1 |
| 16 | 12.1 | 12.1 | 13.6 | 13.6 | 13.6 | 13.6 |
| 17 | 11.4 | 11.4 | 13.1 | 13.1 | 13.1 | 13.1 |
| 18 | 10.8 | 10.8 | 12.7 | 12.7 | 12.7 | 12.7 |
| 19 | 10.3 | 10.3 | 12.3 | 12.3 | 12.3 | 12.3 |
| 20 | 9.7 | 9.7 | 11.9 | 11.9 | 11.9 | 11.9 |
| 21 | 9.3 | 9.3 | 11.5 | 11.5 | 11.5 | 11.5 |
| 22 | 8.9 | 8.9 | 11.1 | 11.1 | 11.1 | 11.1 |
| 23 | 8.5 | 8.5 | 10.8 | 10.8 | 10.8 | 10.8 |
| 24 | 8.2 | 8.2 | 10.5 | 10.5 | 10.5 | 10.5 |
| 25 | 7.8 | 7.8 | 10.2 | 10.2 | 10.2 | 10.2 |

TABLE C-continued

HIGH AND LOW BOUNDRIES OF THE DESIGN ENVELOPE

This table displayes the relationships between the TOTAL ENERGY LEVEL stored in the ENERGY STORAGE & DISSIPATION DEVICE, the RATE OF ENERGY INPUT (POWER) needed to reach the next listed total energy level, and the POWER needed to maintain (overcome resistance) at a given energy level. SPEED is the equivalent of road speed if used with a bicycle type exerciser.

| | INCREMENTAL CHANGE, in %, LEVEL TO LEVEL, OF | | | | | |
|---|---|---|---|---|---|---|
| | TOTAL | | POWER (LB-FT/SEC) | | | |
| ENERGY LEVEL MPH | ENERGY LEVEL (LB-FT) | | TO REACH NEXT LEVEL | | TO MAINTAIN PRESENT LEVEL | |
| SPEED | LOW | HIGH | LOW | HIGH | LOW | HIGH |
| 26 | 7.5 | 7.5 | 9.9 | 9.9 | 9.9 | 9.9 |
| 27 | 7.3 | 7.3 | 9.6 | 9.6 | 9.6 | 9.6 |
| 28 | 7.0 | 7.0 | 9.3 | 9.3 | 9.3 | 9.3 |
| 29 | 6.8 | 6.8 | 9.1 | 9.1 | 9.1 | 9.1 |
| 30 | 6.6 | 6.6 | 8.8 | 8.8 | 8.8 | 8.8 |
| 31 | 6.3 | 6.3 | 8.6 | 8.6 | 8.6 | 8.6 |
| 32 | 6.2 | 6.2 | 8.4 | 8.4 | 8.4 | 8.4 |
| 33 | 6.0 | 6.0 | 8.2 | 8.2 | 8.2 | 8.2 |
| 34 | 5.8 | 5.8 | 8.0 | 8.0 | 8.0 | 8.0 |
| 35 | 5.6 | 5.6 | 7.8 | 7.8 | 7.8 | 7.8 |
| 36 | 5.5 | 5.5 | 7.6 | 7.6 | 7.6 | 7.6 |
| 37 | 5.3 | 5.3 | 7.4 | 7.4 | 7.4 | 7.4 |
| 38 | 5.2 | 5.2 | 7.2 | 7.2 | 7.2 | 7.2 |
| 39 | 5.1 | 5.1 | 7.1 | 7.1 | 7.1 | 7.1 |
| 40 | 4.9 | 4.9 | 6.9 | 6.9 | 6.9 | 6.9 |
| 41 | 4.8 | 4.8 | 6.8 | 6.8 | 6.8 | 6.8 |
| 42 | 4.7 | 4.7 | 6.6 | 6.6 | 6.6 | 6.6 |
| 43 | 4.6 | 4.6 | 6.5 | 6.5 | 6.5 | 6.5 |
| 44 | 4.5 | 4.5 | 6.4 | 6.4 | 6.4 | 6.4 |
| 45 | 4.4 | 4.4 | 6.2 | 6.2 | 6.2 | 6.2 |
| 46 | 4.3 | 4.3 | 6.1 | 6.1 | 6.1 | 6.1 |
| 47 | 4.2 | 4.2 | 6.0 | 6.0 | 6.0 | 6.0 |
| 48 | 4.1 | 4.1 | 5.9 | 5.9 | 5.9 | 5.9 |
| 49 | 4.0 | 4.0 | 5.8 | 5.8 | 5.8 | 5.8 |
| 50 | 4.0 | 4.0 | 5.7 | 5.7 | 5.7 | 5.7 |

*END*

In general, the data shown by the Tables illustrates that the power required to increase the level of exercise gradually increases from the lower levels of exercise to the higher levels of exercise. For example, as shown by column 3 of Table A, incremental change of levels requires approximately an additional 10 pounds-feet per second from level 10 to 11, approximately an additional 28 pounds-feet per second from level 20 to 21, approximately an additional 58 pounds-feet per second from level 30 to 31, and approximately an additional 100 pounds-feet per second from level 40 to 41.

The data shown by the Tables also illustrates that the power required to maintain any particular level of exercise very gradually increases from the lower levels of exercise to the higher levels of exercise. For example, as shown by column 4 of Table A, differences in power to maintain levels of exercise are 5 pounds per feet per second between level 10 and 11; 13 pounds per feet per second between level 20 and 21; 29 pounds per feet per second between level 30 and 31; and 50 pounds per feet per second between level 40 and 41.

Table B also shows a low-high range of total energy values of between approximately 2 to 6 pounds-feet at level one and approximately 4000 to 16,000 pounds-feet at level 50; a range of power to effect level change of between approximately 1 to 5 (LB-FT/SEC) at level 1 and approximately 1300 to 5200 (LB-FT/SEC) at level 50; and a range of power to maintain level of between approximately 1 to 2 (LB-FT/SEC) at level 1 and approximately 650 to 2600 (LB-FT/SEC) at level fifty. In addition, Table C shows that the incremental percentage change in increase of energy stored in the system and power required to change from one level to another level of exercise and to maintain a particular level of exercise very gradually decreases between level 10 and level 50. It is to be understood that levels 1 through 10 are of relatively little significance in connection with the exercises to be performed in accordance with the present invention.

In general, the present invention provides an exercise system wherein in the ranges of levels of increased exercise beyond a minimum level of exercise (e.g. level 10), whereat the system provides between approximately 160 to 640 foot pounds of stored energy and the system requires a minimum of between approximately 23 to 95 pounds-feet per second of power to increase the minimum level of exercise and the system requires between 12 to 46 pounds-feet per second of power to maintain said minimum level of exercise, the system contains (1) means for gradual increase of stored energy as the level of exercise is increased to a maximum of at least in the range of approximately 4000 to 16,000 foot-pounds by incremental percentage rates of increase of stored energy which gradually decrease as the level of exercise is gradually increased between a range of approximately 20% to 4% (columns 2 & 3, Table C; (2) the system further contains means for gradual increase of power required to increase the level of exercise as the level of exercise increases from 23 to 93 at level 10 to a maximum of at least in the range of approximately 1300 to 5200 pounds-feet per second at level 50 by only incremental percentage rates of increase of power which gradually decrease as the level of exercise is gradually increased between a range of approximately 22% at level 10 to 5.7% at level 50: and the system further contains means for gradual increase of power required to maintain each increased level of exercise of at least in the range of approximately 12 to 46 at level 10 to 650 to 2600 foot-pounds per second at level 50 by only gradual incremental percentage rates of increase of power which gradually decrease between a range of approximately 22% to 5% as the level of exercise is increased.

In general, the apparatus of FIGS. 15–22 of the present invention comprises a support stand means 630 for supporting the apparatus in a vertically upwardly extending attitude on a horizontal surface of the ground or a floor or the like; a combination flywheel inertial energy storage means and variable load-applying means 632 for energy storage and input of stored energy while providing automatic variably increasable and decreasable resistance to applied energy.

A manually operable energy input means 634 is mounted at the upper end of the stand means including a relatively large diameter rotatable gear means 636; a variable diameter chain-driven one way clutch type sprocket means 638 drivably connected to the gear means 636, and a non-slip toothed timing belt-type power transfer means 640 operable by the gear means 636 for transfer of manually generated input energy to the energy storage-variable resistance means 632.

The stand means 630 comprises a one-piece casting member 650 having a base portion 652, an upwardly extending rearwardly inclined lower leg portion 654, a bifurcated central intermediate hub portion 656 with spaced arm portions 658, 660 on opposite sides of a central vertical slot 662 and an upwardly forwardly extending upper leg portion 664 terminating in an upper hub portion 666.

Base portion 652 has a central portion 670 with a flat bottom surface 672 and opposite pairs of outwardly extending outwardly inwardly tapered stub shaft portions 673, 674, 675, 676. Each stub shaft portion has opposite upper and lower circular segment portions 678, 679 and groove portions 680, 681 which are adapted to slidably telescopically frictionally receive hollow tubular support arm members 682, 683, 684, 685 having a corresponding cross-sectional configuration at the attachment end portion. The outside diameter of the tubular support arm members is such as to provide a lowermost outer peripheral surface portion 68 which is substantially coplanar with bottom surface 672. Threaded fastener means 687, 688 may be employed to fixedly connect each support arm member to the associated stub shaft portion. Cap members 689, 690 may be mounted on the laterally outer end portion of each support arm member.

Lower support leg portion 654 has an I-shape cross-sectional configuration with opposite flange portions 691, 692 connected by a central intermediate web portion 693 Each flange portion has outwardly flared upper sections 694, 696 which are substantially axially co-extensive with intermediate hub portion 656 to provide rigid support therefor.

Intermediate hub portion 656 comprises a pair of axially aligned central horizontally extending bores 700, 702. Bore 700 is adapted to receive and hold a bearing sleeve member 704. Bore 702 is adapted to receive and hold a ball bearing assembly 706, including snap ring members 708, 710. Bearing means 704, 706 rotatably support an elongated central shaft member 712.

Upper support leg portion 664 has an I-shaped cross-sectional configuration with opposite flange portions 720, 722 connected by a central intermediate web portion 724 which support upper hub portion 666. The lower end portion 726 of web portion 644 is axially offset to provide a side surface 728 which is coplanar with side surface 730 of central hub portion 656. A support shaft member 732 is fixedly threadably mounted in an opening 734 of lower end portion 726. A support sleeve member 736 and a bearing sleeve member 738 are mounted on support shaft member 732 by a washer 740 and a threaded nut 742 for rotatably supporting an idler pulley 744.

Upper hub portion 666 has a central bore 750 which fixedly supports an upper shaft member 752 including axially spaced threaded end portions 754, 756. Threaded end portion 754 is threaded into a threaded bore 758 and receives a lock nut 760 in abutting engagement with hub side surface 762.

Rotatable gear means 636 comprises a central hub member 764 rotatably mounted on bearing sleeve members 766, 768 on a central intermediate portion of shaft member 752. Central hub member 764 is fixedly connected to a hub portion 770 from which a plurality of spoke portions 771, 772, 773, 774, 775, 776 extend radially outwardly to a rim portion 778. Each spoke portion has an I-shape cross-sectional configuration with spaced flange portions 780, 782 connected by an intermediate web portion 784. The outer periphery of rim portion 778 has a plurality of uniformly circumferentially spaced gear teeth 786 for drivable non-slip engagement with corresponding teeth 788 on continuous loop belt means 640. A threaded stub shaft end portion 790 of hub member 764 fixedly threadably supports a sprocket cluster and one-way clutch means 638 whereby one-way rotation of one of the sprockets by a chain means 792 causes corresponding one-way rotation of the gear means 636. The construction and arrangement is such that the rear wheel fork portions 794, 796 of an associated exercise device may be mounted on and supported by shaft end portions 754, 756 by use of threaded nut members 797, 798.

Energy storage-variable resistance wheel means 632 comprises a central hub portion 800 fixedly secured on a tapered end portion 802 of shaft member 712 by a threaded shaft end portion 804 and lock nut member 806. A plurality of radially outwardly extending circumferentially spaced spoke fan blade portions 808, 809, 810, 811, 812, 813 connect hub portion 800 to a rim portion 814. Each of the spoke portions have a curved vane-shape cross-sectional configuration whereby, during rotation, air is driven axially inwardly and radially outwardly through the openings therebetween in the direction of the arrow 816 toward the transmission system and bearings for shaft member 712 and 752.

In operation of the exercise system, manually generated input force is transmitted to a selected one of the drive sprocket wheels through chain member 792 drivably associated therewith. The drive sprocket assembly is drivably connected to large diameter gear wheel 636 through a one-way clutch mechanism. Gear wheel 636 is freely rotatably mounted on a shaft 752. A continuous loop toothed belt 640 is operatively mounted on the periphery of the gear wheel 636 and on the periphery of pinion gear means 822 on shaft 712 so that rotation of gear wheel 636 cause rotative movement of the belt which causes rotation of the pinion means at a faster rpm than the gear wheel. In the presently preferred embodiment, the gear wheel and the pinion means have peripheral teeth which engage corresponding teeth on the inner periphery of the drive belt as provided in conventional timing belt drive systems. An adjustable positionable idler pulley 744 is provided to engage the flat outer peripheral surface of the drive belt to provide proper belt tension. Pinion means 822 is fixedly mounted on one end of drive shaft 712 and causes rotation thereof. The energy storage and variable resistance wheel means 632 is fixedly mounted on the other end of shaft 712 and is rotatable therewith. Thus, manually generated input force is transferred to a selected one of the variable diameter sprocket wheels of sprocket assembly 638 which have varying diameters and numbers of sprocket teeth to provide varying gear ratios (mechanical advantage) such as utilized in conventional multiple-speed bicycle drive systems. The diameter of gear wheel 636 is larger than the diameter of any of the variable diameter sprocket wheels so as to provide an increase in peripheral angular velocity. The provision of teeth on the sprocket wheel and the drive, belt and the pinion means provides positive non-slip force transfer therebetween and enables precision calculation of energy transfer therebetween. Energy storage and variable resistance wheel means 632 is fixedly mounted on shaft 712 and is rotated at exactly the same rpm as the shaft which is rotated in exact variably increased rpm relative to drive gear means 636.

The aforedescribed system may be employed with a variety of energy input exercise devices such as a bicycle exercise device, a rowing exercise device, etc. and may be utilized to provide an exercise system adaptable to a variety of exercises and a variety of exercise devices.

Figure 15:
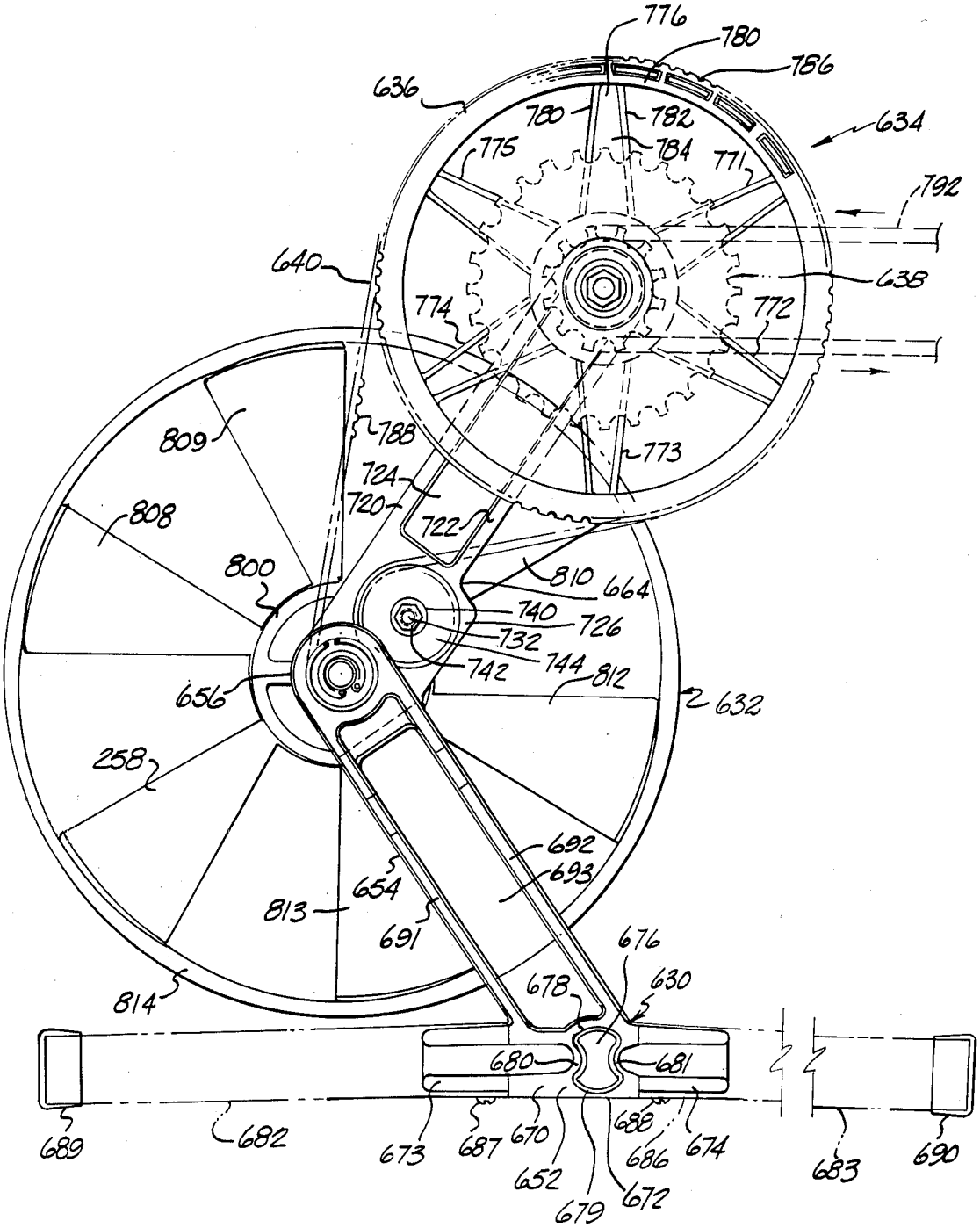
FIG. 15 is a side elevational view of an illustrative and presently preferred embodiment of an exercise apparatus of the present invention which may be used in combination with various types of manually operated input devices.
Figure 16:
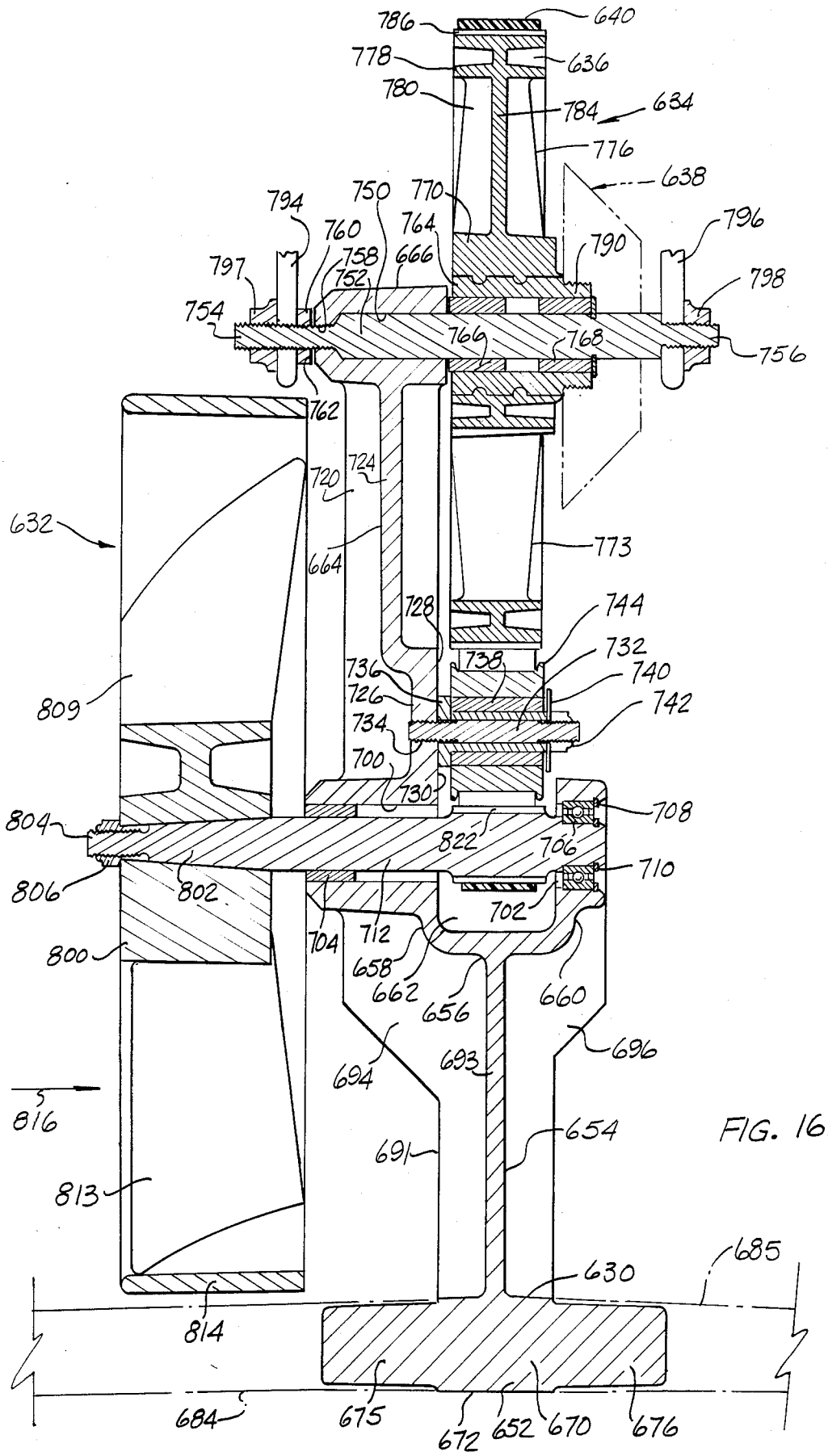
FIG. 16 is an enlarged cross-sectional view of the apparatus of FIG. 15.
Figure 17:
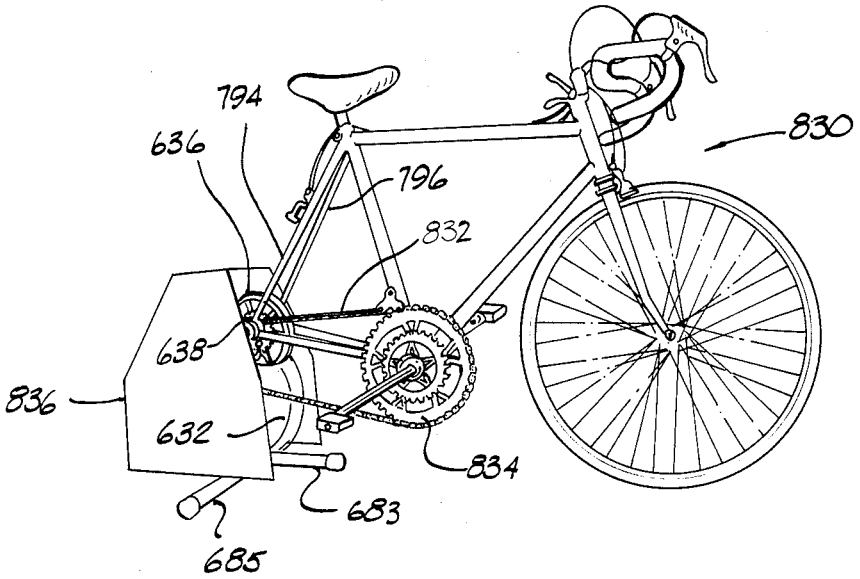
FIG. 17 is a schematic perspective view of a bicycle-type exercise system including the apparatus of FIG. 15 as in use in combination with a conventional multi-speed bicycle with the rear wheel removed.

As shown in FIG. 17, the apparatus of FIGS. 15 and 16 may be used with a conventional single speed or multiple speed bicycle 830 upon removal of the rear wheel (not shown) and attachment of the rear wheel fork portions 794, 796 of the bicycle frame to outer end portions 754, 756 of shaft means 752 as previously described. The drive chain 832 of the bicycle transmission system is connected to sprocket wheel means 638. Thus, the conventional multiple speed bicycle drive system 834 may be used in a conventional manner in conjunction with sprocket wheel means 638 to provide variable speed operation. The rear end of the bicycle is supported in a stable stationary attitude so that a person may sit on the bicycle and apply rotative pedaling force to the bicycle drive system to operate the exercise apparatus. A shroud or cover 836 may be mounted on apparatus 630, 632, 634, etc. and have an air outlet means to direct air flow from load-applying means 632 onto the body of the exercisor to reduce overheating during exercise.

Figure 18:
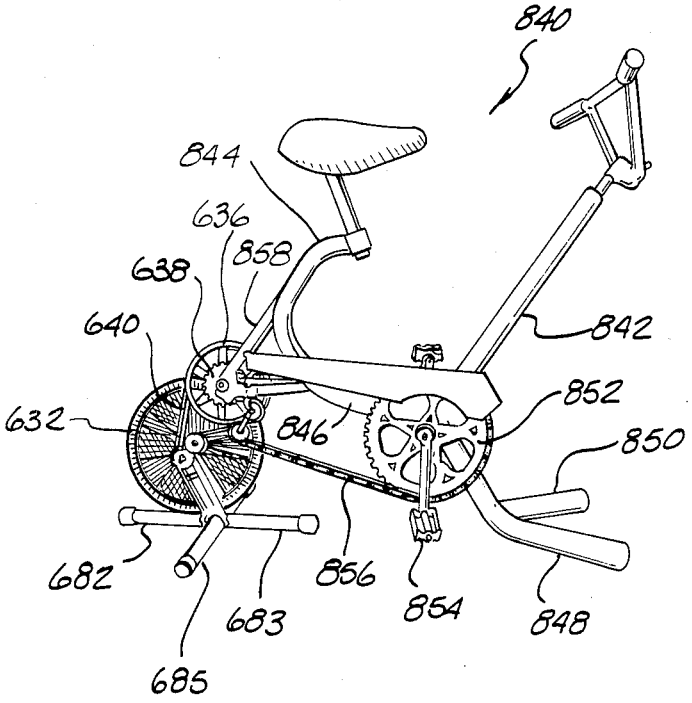
FIG. 18 is a schematic perspective view of a stationary bicycle stand-type exercise system including the apparatus of FIG. 15 in use in combination with a stationary bicycle stand-type exercise device.

FIG. 18 shows a stationary-type bicycle-type exercise system 840 comprising a tubular frame means 842 with a seat support portion 844, an intermediate portion 84,, a handle bar portion 846, and a pair of support leg portions 848, 850. A drive sprocket wheel 852, operated by a rotary pedal mechanism 854, is connected to sprocket means 638 by a drive chain 856. Rear fork portions 858 of the frame are attached to the apparatus of FIGS. 15 and 16 as previously described.

Figure 19:
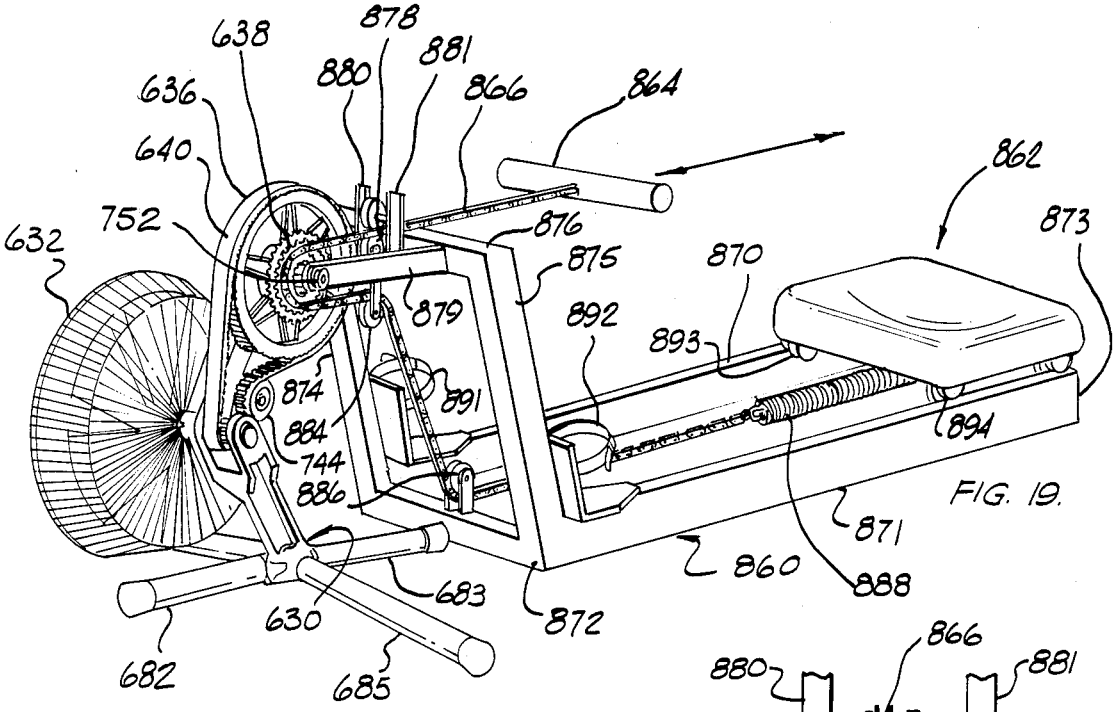
FIG. 19 is a schematic perspective view of a rowing type exercise system including the apparatus of FIG. 15 in use in combination with a rowing-type exercise device.
Figure 20:
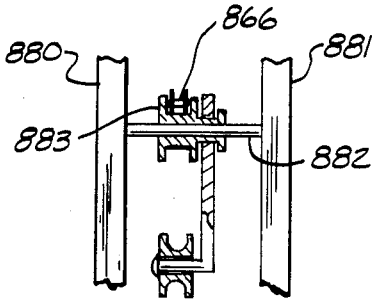
FIG. 20 is a side elevational view of a chain guide and shift apparatus of the system of FIG. 19.
Figure 21:
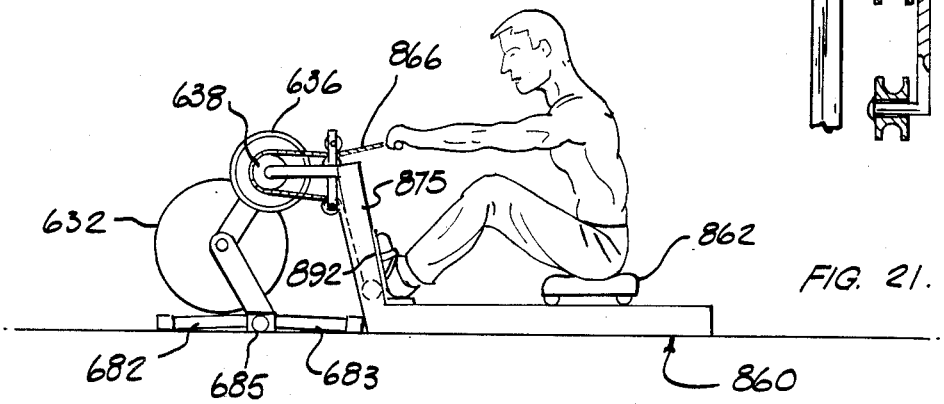
FIGS. 21, 22 are schematic side elevation views illustrating the use of the exercise system of FIG. 19.
Figure 22:
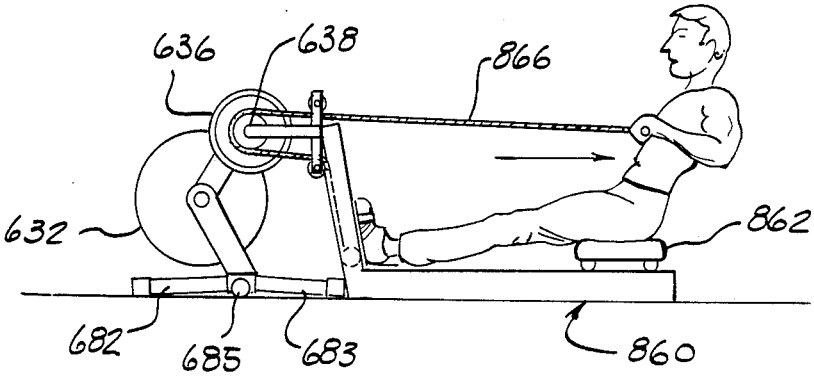

FIGS. 19–21 show a rowing-type exercise system comprising a frame means 860 which supports a reciprocable slidable seat means 862. A handle means 864 is connected by a reciprocable chain means 866 to chain driven force input 638 sprocket means. Frame means 860 comprises a pair of horizontal side frame members 870, 871, horizontal end frame members 872, 873 upwardly extending vertically support members 874, 875 and an upper cross brace member 876. A pair of attachment arm members 878, 879 extend forwardly from frame member 876 and are connected to shaft means 752 as previously described. A pair of vertical members 880, 881 support a shaft 882 and an axially displaceable guide pulley 883 for chain means 866 which extends around the input sprocket means 888 mounted on a pulley means 890 and fixed at one end to the frame means so as to be extendable under load applied through the claim means. Foot support and strap means 891, 892 are mounted on frame members 874, 875. Seat means 862 is slidably supported on frame means 870, 871 by roller means 893, 894. As shown in FIGS. 20 and 21, a person sits on seat means 862 and places the feet in foot support and strap means 882, 883. Then, the person may push against frame portions 874, 875 while grasping handle means 864 to force seat means 862 from a forward position to a rearward position while extending chain means 866 is pulled forwardly by spring means 888. Then the person repeats the rearward movement in the fashion of rowing a boat. The chain means may be shifted from sprocket to sprocket by axial displacement of guide pulley 883.

The above described apparatus and method of exercise provides an exercise system comprising manually operated movable drive means for manual operation by persons for exercise caused by resistance to motion thereof; stationary support stand means for mounting said manually operated drive means; energy storage means mounted on said support means operatively connected to said manually operated movable drive means for delivery of energy to said energy storage means; continuously operable energy-level-responsive resistance changing means for automatically increasing and decreasing the quantity of energy dissipated in accordance with the instantaneous level of energy present in the energy storage means; the construction and arrangement and relationship of the energy input means, the drive means and the energy storage means and the energy-level-responsive resistance changing means being such as to provide inter-related characteristics therebetween which are defined in part by the following characteristics at 5 level intervals:

| LEVEL | INSTANTANEOUS STORED ENERGY RANGE, LB-FT | |
|---|---|---|
| 10 | FROM 160 to | 639 lb-ft |
| 15 | 360 | 1439 |
| 20 | 639 | 2558 |
| 25 | 999 | 3996 |
| 30 | 1439 | 5754 |
| 35 | 1958 | 7832 |
| 40 | 2527 | 10230 |
| 45 | 3237 | 12937 |
| 50 | 3996 | 15984 |

In addition, the characteristics of the energy storage means and energy-level-responsive means are such that the rate of work required ("power" expressed as lb-ft/sec) to reach the next energy level varies with the stored energy level as indicated by Tables A to C.

In the currently preferred designs, the energy storage means is combined with the resistance changing means, i.e., the flywheel, which stores energy, has air flow blades which cause acceleration of air and also cause turbulence. Both air acceleration and turbulence dissipate energy (create resistance to rotation of fan-flywheel), and both are speed of rotation dependent. The energy stored in the fan-flywheel at any instant, is $E=\frac{1}{2}$ (Moment of Inertia)(Rotational velocity squared). Thus, energy level rises and falls as the square of velocity, and resistance level will vary as the energy changes. It is to be noted that the product of Moment of Inertia "I", (which is dependent on the weight of the fan-flywheel and its position in respect to the center of rotation), and rotational speed "w", squared, determines the energy level. The combination of "I" and "w" may be varied as necessary or desirable to achieve the desired results.

The present preferred design requires that the TOTAL velocity change ratio, (mechanical disadvantage) between the ENERGY STORING PART and the human input provide a relatively high mechanical disadvantage, for example:

| | |
|---|---|
| Rowing Machine | 16/1 to 32/1 |
| Exercycle | 8/1 to 48/1 |
| Leg and general purpose gym | 4/1 to 320/1 |

With a high enough disadvantage ratio (i.e., velocity of input device is less than velocity of other parts), an ISOKINETIC STATE of exercise, is reached whereat system resistance equals capability of the exercisor to overcome it. In this state, the exercisor can use MAX FORCE but the system prevents the exercisor from moving the input means faster than a selected gear permits.

The use of the cam-type drive systems of my prior U.S. patents are particularly advantageous in that such systems reduce maximum forces required and enable many users to do more work per unit of time at a particular maximum heart rate which is advantageous to athletes in good condition, persons who are not in good condition, and persons with disabilities who are being rehabilitated.

While the inventive concepts have been hereinbefore described with respect to usage with particular exercise systems, it is to be understood that certain of the novel features and advantages of the present invention may be utilized in a construction and arrangement involving other exercise systems. Also, while the illustrative and presently preferred arrangements of the various load-applying devices provide particularly desirable results, the devices may be modified and various combinations of such devices may be utilized as necessary or desirable. Thus, it is intended that the appended claims be construed to include alternative embodiments and modifications except insofar as limited by the prior art.

What is claimed is:

1. An exercise system comprising:

manually operated movable drive means including a driven wheel means for manual operation by a person at a first variable operational velocity for exercise caused by resistance to motion thereof;

stationary support stand means for mounting and supporting said manually operated drive means;.

velocity change means associated with said manually operable movable drive means for changing the first variable operational velocity to a second operational velocity;

fly wheel means mounted on said stationary support stand means and being operatively connected to said manually operated movable drive means through said velocity change means for energy storage and continuous application of momentum force thereto during manual operation thereof; and velocity responsive variable resistance load applying means for continuously automatically applying variable resistance loads to said manually operated drive means and for automatically increasing and decreasing the resistance load applied to said manually operated movable drive means in accordance with the operational velocity of the system, the construction and arrangement of the system being such as to provide an envelope of preselected exercise parameters including a total energy level, a power level to overcome energy dissipation and maintain a given level and enable change to another power level, and a mechanical advantage ratio which are selected to provide high level cardio-aerobic development shaft means mounted on said support stand means for rotatably supporting said flywheel means and said variable resistance load applying means and said driven wheel means;

a first shaft means for rotatably supporting said flywheel means and said variable resistance load applying means;

a second shaft means spaced from said first shaft means for rotatably supporting said driven wheel means; and drive means operatively connecting said driven wheel means to said flywheel means and said variable resistance load applying means for causing rotative movement thereof.

2. The invention as defined in claim 1 and wherein said velocity change means provides a mechanical advantage of at least 10 to 1.

3. The invention as defined in claim 2, and wherein said velocity responsive resistance load applying means comprising:

a rotatable air impelling means connected to and being operable by said manually operated movable drive means through said velocity change means for automatically increasing and decreasing the resistance load through said rotatable air impeller means in response to increases and decreases in resistance to air flow proportional to operational velocity thereof.

4. The invention as defined in claim 3 and wherein said manually operable movable drive means comprising a chain means and a multiple sprocket wheel means for selectively variably applying a selected resistance load to said manually operated movable drive means.

5. The invention as defined in claim 1 wherein:

the exercising apparatus being constructed and arranged for use with a plurality of different exercise devices;

said support stand means being constructed and arranged for mounting components of said exercise devices.

6. The invention as defined in claim 5, and wherein one of said exercise devices is a bicycle-type exercise device.

7. The invention as defined in claim 5 and wherein one of said exercise devices is a rowing-type exercise device.

8. The invention as defined in claim 5, and wherein said support stand means comprising:

lower support means for supporting one end of said exercise devices and said driven wheel means and said variable resistance load applying means on a floor surface; and upwardly extending support means on said lower support means and associated shaft means for supporting said driven wheel means and said flywheel means and said variable resistance load-applying means independently of said exercise devices.

9. The invention as defined in claim 8 and wherein said upwardly extending support means comprising:

spaced vertically extending members and shaft means mounted between and rotatably supported by said members for supporting said driven wheel means and said flywheel means and said variable resistance load-applying means.

10. The invention as defined in claim 8 and further comprising:

mounting means associated with said support means for releasably holding an end portion of said exercise devices.

11. The invention as defined in claim 1 and further comprising:

drive means operatively connecting said driven wheel means and said flywheel means and said variable resistance load applying means for causing rotation of said flywheel means and said variable resistance load applying means at variable velocities directly proportional to the rotational velocity of said driven wheel means.

12. The invention as defined in claims 1 or 11 and wherein:

the exercising apparatus being constructed and arranged for simulating the characteristics of exercise during the actual riding of a bicycle; and said flywheel means being calibrated and designed and having a mass sufficient for storage of energy approximately equal to the momentum created by the weight of the rider and bicycle during actual bicycle riding at various speeds and constructed and arranged for continuous automatic variation of momentum in accordance with the operational speed of said manually operated movable drive means.

13. The invention as defined in claim 12 and wherein:

said variable resistance load applying means being calibrated and designed for creating variable resistance loads approximately equal to resistance loads encountered during actual riding of a bicycle at various speeds, and being constructed and arranged for continuous automatic variation of applied resistance in accordance with operational speed of said manually operated movable drive means.

14. The invention as defined in claim 13 and wherein:

said variable resistance load applying means being further calibrated and designed for creating variable resistance loads approximately equal to resistance loads encountered during actual riding of a bicycle on terrain of varying grade, and being constructed and arranged for selective variation of applied resistance in accordance with selected variable grade conditions to be simulated.

15. The invention as defined in claims 1 or 11 and further comprising:

a first pulley means operably associated with said driven wheel means;

a second pulley means operably associated with said flywheel means and said load applying means; and a belt member operably associated with said first pulley means and said second pulley means to cause said driven wheel means to drive said flywheel means and said load applying means.

16. The invention as defined in claims 1 or 11 and wherein said variable resistance load applying means being mounted on said flywheel means.

17. The invention as defined in claim 16 and wherein said variable resistance load-applying means further comprising a plurality of fan blade members mounted on said flywheel means.

18. Exercising apparatus comprising:

manually operated movable drive means for manual operation by a person for exercise caused by resistance to motion thereof;

stationary support stand means for mounting said manually operated drive means;

fly wheel means mounted on said support stand means operatively connected to said manually operated movable drive means for energy storage and continuous application of momentum force thereto during manual operation thereof;

continuously automatically operable speed-responsive resistance load changing means mounted on said support stand means for automatically increasing and decreasing the resistance load applied to said manually operated movable drive means in accordance with the operational speed thereof;

a driven wheel means mounted on said support stand means and operatively connected to said manually operable movable drive means;

shaft means on said support stand means for rotatably supporting said flywheel means and said load changing means and said driven wheel means:

a first shaft member for rotatably supporting both said flywheel means and said load changing means and a second shaft member for rotatably supporting said driven wheel means; and intermediate drive means for drivably connecting said drive wheel means on said first shaft member to said flywheel means and said load changing means on said second shaft member.

19. The invention as defined in claim 18 and wherein:

said driven wheel means comprising a toothed wheel member having a relatively large diameter and teeth thereon;

said intermediate drive means comprising a continuous loop toothed belt member having teeth thereon for non-slip positive engagement with the teeth on said toothed wheel member; and toothed means operably drivably associated with said second shaft member for operative engagement with said toothed belt member.

20. The invention as defined in claim 19 and further comprising:

variable speed input means mounted on said second shaft member and being drivably connected to said driven wheel means for driving said driven wheel means at variable selected speeds.

21. The invention as defined in claim 20 and wherein:

said manually operable drive means comprises a chain member and said variable speed input means comprises at least one-sprocket wheel member.

22. The invention as defined in claim 21, and wherein:

said flywheel means and said load changing comprise a single unit having a common support hub means mounted on said first shaft member.

23. The invention as defined in claim 22, and wherein:

said load changing means comprises a plurality of radially extending circumferentially spaced blade members having an axial curvature such as to cause axial movement of air thereacross and to provide air resistance which increases proportionately to rotational speed thereof.

24. The invention as defined in claim 23 and wherein:

said manually operable drive means is associated with a bicycle-type exercise device and comprising a rotatable pedal-operated crank means, at least one rotatable drive sprocket member operably connected to said crank means, a continuous loop chain member operably connected to said drive sprocket member, and at least one rotatable driven sprocket member operably connected to said chain member and to said driven wheel means.

25. The invention as defined in claims 23 and wherein said manually operable drive means is associated with a rowing-type exercise device and comprises:

a movable handle means for gripping by a person performing an exercise;

at least one rotatably driven sprocket means operably connected to said driven wheel means for causing rotation thereof;

an extendable and retractable chain means connecting said handle means to said sprocket means for causing rotation thereof;

an elongated frame means for supporting said rowing-type exercises device; and movable seat means on said frame means for enabling back and forth movement of the person forming the exercise.

26. An exercise system for enabling an human being to perform an exercise by manually generated input force applied against a load through a drive system and comprising:

manually operable force input means for applying the input force to the exercise system;

a force transmission drive means operably connected to said force input means for receiving the input force from the force input means;

an energy storage means for storing energy generated by the exerciser;

a resistance load applying means for applying a resistance load to the input force of the exerciser;

support stand means for supporting said force input means and said drive means and said energy storage means and said resistance load applying means;

said energy storage means comprising a rotatable wheel device having a diameter and weight such as to store energy proportional to input energy;

said resistance load means comprising a rotatable wheel means having blade members thereon for causing a flow of air across said blade members and providing a resistance to air flow which is proportional to the speed of rotation of said rotatable wheel means;

an intermediate drive system means between said force transmission drive means and said energy storage means and said variable resistance load means which comprises only direct positive drive elements having toothed surfaces;

a first drive system connecting said force input means to a first shaft means for rotatably supporting at least one driven sprocket; and a second drive system connecting said first shaft means to a second shaft means for rotatably supporting said energy storage means and said resistance load applying means.

27. The invention as defined in claim 26 and wherein said second drive system comprising:

a relatively large diameter sprocket wheel means mounted on said first shaft means for rotation by said driven sprocket;

a relatively small diameter sprocket wheel means mounted on said second shaft means for rotation by said large diameter sprocket wheel means; and a toothed drive belt means for connecting said large diameter sprocket wheel means to said small diameter sprocket wheel means.

28. The invention as defined in claims 26 or 27 and wherein said support stand means comprises:

first support stand apparatus for independently supporting said energy storage means and said resistance load applying means and said intermediate drive system means;

second support stand apparatus for supporting said manually operable force input means and aid force transmission drive means; and coupling means for connecting said first support stand apparatus to said second support stand apparatus.

29. The invention as defined in claim 28 and wherein the system is constructed and arranged to provide a rowing-type exercise device.

30. The invention as defined in claim 28 and wherein the system is constructed and arranged to provide a bicycle-type exercise device.

31. The invention as defined in claim 28 and wherein the system is constructed and arranged to enable usage for multiple-type exercises including at least a rowing-type exercise and a bicycle-type exercise.

32. An exercise system comprising:

manually operated movable drive means including driven wheel means for manual operation by a person at a first variable operational velocity for exercise caused by resistance to motion thereof;

stationary support stand means for mounting and supporting said manually operated drive means;

velocity change means associated with said manually operable movable drive means for changing the first variable operational velocity to a second operational velocity;

fly wheel means mounted on said stationary support stand means and being operatively connected to said manually operated movable drive means through said velocity change means for energy storage and continuous application of momentum force thereto during manual operation thereof;

velocity responsive variable resistance load applying means for continuously automatically applying variable resistance loads to said manually operated drive means and for automatically increasing an decreasing the resistance load applied to said manually operated movable drive means in accordance with the operational velocity of the system, the construction and arrangement of the system being such as to provide an envelope of preselected exercise parameters including a total energy level, a power level to overcome energy dissipation and maintain a given level and enable change to another power level, and a mechanical advantage ratio which are selected to provide high level cardio-aerobic development;

shaft means mounted on said support stand means for rotatably supporting said flywheel means and said variable resistance load applying means and said driven wheel means;

said movable drive means operatively connecting said driven wheel means and said flywheel means and said variable resistance load applying means for causing rotation of said flywheel means and said variable resistance load applying means at variable velocities directly proportional to the rotational velocity of said driven wheel means;

a first pulley means operably associated with said driven wheel means;

a second pulley means operably associated with said flywheel means and said load applying means; and a belt member operably associated with said first pulley means and said second pulley means to cause said driven wheel means to drive said flywheel means and said load applying means.

33. An exercise system comprising:

manually operated movable drive means including a driven wheel means for manual operation by a person at a first variable operational velocity for exercise caused by resistance to motion thereof;

stationary support stand means for mounting and supporting said manually operated drive means;

velocity change means associated with said manually operable movable drive means for changing the first variable operational velocity to a second operational velocity;

fly wheel means mounted on said stationary support stand means and being operatively connected to said manually operated movable drive means through said velocity change means for energy storage and continuous application of momentum force thereto during manual operation thereof;

velocity responsive variable resistance load applying means for continuously automatically applying variable resistance loads to said manually operated drive means and for automatically increasing and decreasing the resistance load applied to said manually operated movable drive means in accordance with the operational velocity of the system, the construction and arrangement of the system being such as to provide an envelope of preselected exercise parameters including a total energy level, a power level to overcome energy dissipation and maintain a given level and enable change to another power level, and a mechanical advantage ratio which are selected to provide high level cardio-aerobic development;

the exercising system being constructed and arranged for use with a plurality of different exercise devices; and said support stand means being constructed and arranged for mounting components of said exercises devices.

34. The invention as defined in claim 33, and wherein one of said exercises devices is a bicycle-type exercises device.

35. The invention as defined in claim 33 or 34 and wherein one of said exercise devices is a rowing-type exercise device.

36. An exercise system comprising:

manually operated movable drive means including a driven wheel means for manual operation by a person at a first variable operational velocity for exercise caused by resistance to motion thereof;

stationary support stand means for mounting and supporting said manually operated drive means;

velocity change means associated with said manually operable movable drive means for changing the first variable operational velocity to a second operational velocity;

fly wheel means mounted on said stationary support stand means and being operatively connected to said manually operated movable drive means through said velocity change means for energy storage and continuous application of momentum force thereto during manual operation thereof;

velocity responsive variable resistance load applying means for continuously automatically applying variable resistance loads to said manually operated drive means and for automatically increasing and decreasing the resistance load applied to said manually operated movable drive means in accordance with the operational velocity of the system, the construction and arrangement of the system being such as to provide an envelope of preselected exercise parameters including a total energy level, a power level to overcome energy dissipation and maintain a given level and enable change to another power level, and a mechanical advantage ratio which are selected to provide high level cardio-aerobic development;

said velocity change means provides a mechanical advantage of at least 10 to 1;

a rotatable air impelling means connected to an being operable by said manually operated movable drive means through said velocity change means for automatically increasing and decreasing the resistance load through said rotatable air impeller means in response to increases and decreases in resistance to air flow proportional to operational velocity thereof;

said manually operable movable drive means comprising a chain means and a multiple sprocket wheel means for selectively variably applying a selected resistance load to said manually operated movable drive means; and lower support means for supporting one end of said exercise device and said driven wheel means and said variable resistance load applying means on a floor surface; and upwardly extending support means on said lower support means and an associated shaft means for supporting said driven wheel means and said flywheel means and said variable resistance load-applying means independently of said exercise device.

37. The invention as defined in claim 36 and wherein said upwardly extending support means comprising:

spaced vertically extending members and shaft means mounted between and rotatably supported by said members for supporting said driven wheel means and said flywheel means and said variable resistance loadapplying means.

38. The invention as defined in claim 36 or 37 and further comprising:

mounting means associated with said support means for releasably holding an end portion of said exercise device.

39. The invention as define in claims 1 or 2 or 3 or 4 or 11 or 18 or 19 or 20 or 21 or 24 or 25 or 26 or 27 or 32 or 33 or 36 or 37 and wherein:

the construction and arrangement being such as to provide a total energy level of between approximately 160 to 640 LB-FT at the minimum level of exercise and between approximately 4000 to 16,000 LB-FT at the maximum level of exercise;

and wherein in the ranges of levels of increase exercise beyond the minimum level of exercise, the system includes means for requiring a minimum range of input power of between approximately 20 to 100 pounds feet per second of power to increase the minimum level of exercise and for requiring between apporximately 10 to 50 pounds feet per second of power to maintain said minimum level of exercise, the system further includes means for gradual increase of power required to increase the level of exercise as the level of exercise increases by only incremental percentage rates of increase of power which gradually decrease between a range of approximately 22% to 5.7% as the level of exercise is gradually increased, and the system further provides means for gradual increase of power required to maintain each increased level of exercise by only gradual incremental percentage rates of increase of power which gradually decrease between a range of approximately 22% to 5.7% as the level of exercise is increased.

40. The invention as defined in claim 39 and wherein the construction and arrangement being such as to enable gradual increase of power required to maintain any given level of exercise and to enable gradual increase of power required to change from one level of exercise to another level of exercise while gradually increasing the level of energy stored in the exercise system in accordance with the following parameters:

| Exercise Level | Total Energy Level (LB-FT) |
|---|---|
| 10 | 160 to 640 |
| 15 | 360 to 1440 |
| 20 | 640 to 2560 |
| 25 | 1000 to 4000 |

-continued

| Exercise Level | Total Energy Level (LB-FT) |
|---|---|
| 30 | 1440 to 5755 |
| 35 | 1960 to 7830 |
| 40 | 2560 to 10000 |
| 45 | 3240 to 12950 |
| 50 | 4000 to 16000 |

* * * * *